US008127590B2

(12) United States Patent
Kohno et al.

(10) Patent No.: US 8,127,590 B2
(45) Date of Patent: Mar. 6, 2012

(54) DIE CUSHION DEVICE OF PRESSING MACHINE

(75) Inventors: Yasuyuki Kohno, Sagamihara (JP); Katsunori Haseba, Sagamihara (JP); Junko Haseba, Sagamihara (JP)

(73) Assignee: Aida Engineering, Ltd., Midori-ku, Sagamihara-shi, Kanagawa (JP)

( * ) Notice: Subject to any disclaimer, the term of this patent is extended or adjusted under 35 U.S.C. 154(b) by 703 days.

(21) Appl. No.: 11/719,337

(22) PCT Filed: Nov. 14, 2005

(86) PCT No.: PCT/JP2005/020829

§ 371 (c)(1),
(2), (4) Date: May 15, 2007

(87) PCT Pub. No.: WO2006/054512

PCT Pub. Date: May 26, 2006

(65) Prior Publication Data

US 2009/0158810 A1 Jun. 25, 2009

(30) Foreign Application Priority Data

Nov. 16, 2004 (JP) ..... 2004-332157

(51) Int. Cl.
*B21J 9/18* (2006.01)

(52) U.S. Cl. ..... 72/453.13

(58) Field of Classification Search ..... 72/453.13, 72/351, 344, 345, 427; 91/448, 433
See application file for complete search history.

(56) References Cited

U.S. PATENT DOCUMENTS

| | | | | |
|---|---|---|---|---|
| 5,339,665 | A * | 8/1994 | Yoshikawa | 72/20.1 |
| 6,085,520 | A * | 7/2000 | Kohno | 60/414 |
| 6,535,827 | B1 * | 3/2003 | Lestina et al. | 702/51 |
| 6,647,870 | B2 * | 11/2003 | Kohno | 100/269.14 |

FOREIGN PATENT DOCUMENTS

| | | | |
|---|---|---|---|
| JP | S63 036931 | | 2/1988 |
| JP | 1-108401 | A | 4/1989 |
| JP | 5-131295 | A | 5/1993 |
| JP | 7-24600 | A | 1/1995 |
| JP | 9-133103 | A | 5/1997 |
| JP | 10-192997 | A | 7/1998 |
| JP | 2000-263299 | A | 9/2000 |
| JP | 2001-96314 | A | 4/2001 |

OTHER PUBLICATIONS

International Search Report for PCT/JP2005/020829 mailed Feb. 7, 2006.

Extended European Search Report dated Mar. 16, 2011 for EP 05806296 (based on PCT/JP2005/020829).

* cited by examiner

*Primary Examiner* — Dana Ross
*Assistant Examiner* — Matthew G Katcoff
(74) *Attorney, Agent, or Firm* — McDermott Will & Emery LLP

(57) ABSTRACT

In a die-cushion device of a press machine a controller controls an opening degree of a proportional flow-rate control valve to an appropriate opening degree in order to control the flow rate flowing out of a lower chamber of a hydraulic cylinder supporting a cushion pad before a slide collides against the cushion pad using a die-cushion pressure command commanded from a commander in advance and a slide speed signal inputted from a slide speed detector. By this, generation of a surge pressure when a slide collides against the cushion pad at a high speed is restricted.

46 Claims, 12 Drawing Sheets

COMMAND→FLOW RATE CHARACTERISTIC DIAGRAM OF PROPORTIONAL FLOW-RATE CONTROL VALVE

DIE CUSHION DEVICE OF PRESSING MACHINE

CROSS REFERENCE TO PRIOR APPLICATION

This is a U.S. national phase application under 35 U.S.C. §371 of International Patent Application No. PCT/JP2005/020829 filed Nov. 14, 2005, and claims the benefit of Japanese Application No. 2004-332157 filed Nov. 16, 2004, both of them are incorporated by reference herein. The International Application was published in Japanese on May 26, 2006 as International Publication No. WO/2006/054512 under PCT Article 21(2).

FIELD OF THE INVENTION

The present invention relates to a die-cushion device of a press machine, and particularly to a die-cushion device which enables control of cushion action and cushion capability of a press machine such as a mechanical press, electric (servo) press and hydraulic press.

BACKGROUND

A cushion-pressure controller which can restrict surge pressure at the start of press molding and pressure override at a switching of press driving speed has been proposed in Japanese Laid-Open Patent Application No. 5-131295 ("JP '295").

The cushion pressure controller of the die-cushion device adjusts an opening degree of a servo valve provided in a discharge flow passage of a hydraulic cylinder by an operation amount signal generated based on a control deviation between a predetermined cushion pressure value and a hydraulic detected value of the hydraulic cylinder supporting a cushion pad and the operation amount signal is additionally changed according to a driving speed of a press slide.

Also, a die-cushion device provided with an NC servo valve for obtaining a cushion action through pressure control of a cushion cylinder of the cushion pad and a position control servo valve for carrying out preliminary acceleration, auxiliary lift, locking and elevating of the cushion pad by control of pressure oil to be supplied to/discharged from an upper chamber and a lower chamber of the hydraulic cylinder supporting the die cushion pad is proposed in Japanese Laid-Open Patent Application No. 7-24600 ("JP '600").

SUMMARY OF THE INVENTION

However, in the cushion pressure controller of the die-cushion device described in JP '295, the opening degree of the servo valve is added in an auxiliary manner according to the press driving speed, but since the discharge flow rate from the hydraulic cylinder is controlled by pressure feedback, if the slide speed is high, a response speed of the servo valve becomes low with respect to the rising response speed of the pressure, which leads to problems that surge pressure can not be restricted sufficiently and if a change is caused in the press driving speed or pressure command, follow-up capability of the pressure to the pressure command becomes poor. Also, since the servo valve is used only as pressure control device for controlling the die-cushion pressure and a pneumatic circuit is provided for operating another cylinder at knock-out action, a plurality of expensive servo valves should be used, which is a problem.

On the other hand, in JP '600, for the purpose of restriction of surge pressure generated when the slide collides against the cushion pad at a high speed, the cushion pad is preliminarily accelerated downward in order to decrease the relative speed of the slide and the cushion pad, but this causes a problem of restriction on molding. Also, the knock-out action is obtained by a position control servo valve different from the NC servo valve. And this causes a problem that expensive servo valves should be used in plural as described in JP '295.

The present invention was made in view of the above circumstances and has an object to provide a die-cushion device of a press machine which can favorably restrict surge pressure when the slide collides against the cushion pad at a high speed, has an excellent follow-up capability to a die-cushion pressure command, and can realize die-cushion pressure control and knock-out position control with an inexpensive device.

In order to achieve the above object, a die-cushion device of a press machine according to one embodiment of the present invention comprises a liquid-pressure cylinder which supports a cushion pad, a proportional flow-rate control valve provided in a flow passage connected to a lower chamber of the liquid-pressure cylinder, a die-cushion pressure command device which outputs a die-cushion pressure command set in advance, a speed detecting device which detects a slide speed of the press machine, and a control device which controls a flow rate discharged from the lower chamber of the liquid-pressure cylinder by controlling an opening degree of the proportional flow-rate control valve, wherein the control device controls an opening degree of the proportional flow-rate control valve before the cushion pad starts lowering by collision of the slide so that the die-cushion pressure becomes a pressure corresponding to the die-cushion pressure command from the time of lowering the cushion pad when the slide of the press machine collides against the cushion pad based on the die-cushion pressure command and the slide speed detected by the slide speed detecting device.

That is, if the opening degree of a servo valve controlling a discharge flow rate from the hydraulic cylinder is controlled by pressure feedback of a lower chamber of the hydraulic cylinder as in previous devices, a surge pressure is generated when a rising response of the pressure of the lower chamber of the hydraulic cylinder is faster than the response of the servo valve at collision between the slide and the die-cushion, but in the present invention, control is made so that the proportional flow-rate control valve has an appropriate opening degree using the die-cushion pressure command set prior to the collision and the slide speed (or cushion pad speed after the collision), so that generation of a surge pressure can be prevented, and control can be made with favorable follow-up capability so that a die-cushion pressure according to the pressure command can be obtained.

A die-cushion of the present invention, where a flow rate discharged from the lower chamber of the liquid-pressure cylinder in proportion to the slide speed detected by the slide speed detecting device is Q and the pressure of the lower chamber of the liquid-pressure cylinder is P, may be such that a valve coefficient Kv in proportion to the opening degree of the proportional flow-rate control valve can be represented from the Bernoulli's principle as follows:

$$Kv=Q/\sqrt{P}$$

and the control device controls the opening degree of the proportional flow-rate control valve based on the valve coefficient acquired by dividing the flow rate calculated using the slide speed detected by the slide speed detecting device by a square root of the pressure command.

Additionally, the slide speed detecting device can be a speed calculating device which calculates a speed by temporal differentiation of a position signal from a position detecting device that detects the slide position or the cushion pad position of the press machine, an angular speed detecting device which detects an angular speed of a driving shaft of the press machine, or an angular speed calculating device which calculates an angular speed by temporal differentiation of an angle signal from an angle detecting device that detects an angle of the driving shaft of the press machine. That is, the speed detecting device is not limited to those directly detecting the speed of the slide or the cushion pad, but the speed calculating device, the angular speed detecting device or the angular speed calculating device can be used.

The control device may include a first operation amount calculation device that calculates an operation amount of the proportional flow-rate control valve based on the die-cushion pressure command and the slide speed detected by the slide speed detecting device and controls the opening degree of the proportional flow rate control valve based on the operation amount.

Alternatively, the control device may include a first operation amount calculation device that calculates an operation amount of the proportional flow-rate control valve based on the die-cushion pressure command and the slide speed detected by the slide speed detecting device, a pressure detecting device that detects the pressure of the lower chamber of the liquid-pressure cylinder, a subtraction calculation device that subtracts the detected pressure signal from the die-cushion pressure command, a correction amount calculating device that calculates a correction amount of the proportional flow-rate control valve based on the subtraction result, and an addition calculation device that adds the operation amount and the correction amount together, and controls the opening degree of the proportional flow-rate control valve based on the addition result.

That is, by correcting the operation amount controlling the opening degree of the proportional flow-rate control valve using the pressure signal obtained by detecting the pressure of the lower chamber of the liquid-pressure cylinder, more accurate pressure control is enabled.

In another embodiment, the control device can have a first operation amount calculation device that calculates an operation amount of the proportional flow-rate control valve based on the die-cushion pressure command and the slide speed detected by the slide speed detecting device, a pressure detecting device that detects the pressure of the lower chamber of the liquid-pressure cylinder, a subtraction calculation device that subtracts the detected pressure signal from the die-cushion pressure command, a limitation calculation device that applies a limitation to the subtraction result, a correction amount calculating device that calculates a correction amount of the proportional flow-rate control valve based on the limitation result, and an addition calculation device that adds the operation amount and the correction amount together, and controls the opening degree of the proportional flow-rate control valve based on the addition result. By this, the correction amount does not exceed a predetermined range, and stability of the control system is ensured.

Alternatively, the control device may include a first operation amount calculation device that calculates an operation amount of the proportional flow-rate control valve based on the die-cushion pressure command and the slide speed detected by the slide speed detecting device, a pressure detecting device that detects the pressure of the lower chamber of the liquid-pressure cylinder, a subtraction calculation device that subtracts the detected pressure signal from the die-cushion pressure command, a correction amount calculation device that calculates a correction amount of the proportional flow-rate control valve based on the subtraction result, an addition calculation device that adds the operation amount and the correction amount together, and a limitation calculation device that applies a limitation to the addition result, and controls the opening degree of the proportional flow-rate control valve based on the limitation result.

The proportional flow-rate control valve can be a 4-port 2-position proportional flow-rate control valve having an A port connected to the lower chamber of the liquid-pressure cylinder, a B port connected to the upper chamber of the liquid-pressure cylinder, a P port connected to a high-pressure source side, and a T port connected to a tank, and it can include an electromagnetic switching valve for opening/closing a flow passage between the P port and the high-pressure source, and a liquid pressure circuit can be provided which can make switching between a pressure controlled state where the die-cushion pressure is controlled by preventing an inflow of a pressure liquid from the high-pressure source to the liquid pressure cylinder through closing of the electromagnetic switching valve at die-cushion pressure control and adjusting an outflow amount from the lower chamber of the liquid-pressure cylinder through adjustment of the opening degree of the 4-port 2-position proportional flow-rate control valve and a position controlled state where a knock-out position is controlled by enabling inflow of the pressure liquid from the high-pressure source to the liquid pressure cylinder through opening of the electromagnetic switching valve and adjusting the opening degree of the proportional flow-rate control valve at knock-out position control. By this, configuration of a liquid pressure circuit at position and speed control of the cushion pad at the die-cushion pressure control and knock-out by a single proportional flow-rate control valve can be simplified.

The die-cushion device may also have a knock-out position command device which outputs a knock-out position command set in advance and a die-cushion position detecting device which detects a position of the cushion pad, and wherein the control device makes control so as to open the electromagnetic switching valve at the knock-out position control and controls the opening degree of the proportional flow-rate control valve so that the position of the die-cushion becomes a position corresponding to the knock-out position command based on the knock-out position command and a position signal detected by the die-cushion position detecting device. By this, by controlling the opening degree of a single proportional flow-rate control valve and the electromagnetic switching valve, the die-cushion pressure control and position and speed control of the cushion pad at knock-out can be made.

Additionally, the control device can have a second subtraction calculation device that subtracts a position signal detected by the die-cushion position detecting device from the knock-out position command and a second operation amount calculation device that calculates an operation amount of the proportional flow-rate control valve based on the subtraction result, and controls the opening degree of the proportional flow-rate control valve based on the operation amount.

The die-cushion device may also include a cushion pad speed detecting device which detects a speed of the cushion pad, and wherein the control device controls the opening degree of the proportional flow-rate control valve so that the die-cushion pressure becomes a pressure corresponding to the die-cushion pressure command after the cushion pa starts lowering integrally with the slide based on either the die-cushion pressure command and the slide speed detected by the slide speed detecting device or the die-cushion pressure command and the cushion pad speed detected by the cushion pad speed detecting device.

According to the present invention, at a collision between the slide and the die-cushion, since the opening degree of the proportional flow-rate control valve can be controlled using a die-cushion pressure command and a slide speed (or cushion pad speed after the collision) so that the die-cushion pressure becomes the commanded pressure, generation of the surge pressure can be prevented. Also, when a changing die-cushion pressure command is given, the die-cushion pressure can be controlled with favorable follow-up capability according to the pressure command. Moreover, the die-cushion pressure control and the knock-out position control can be carried out using a single proportional flow-rate control valve, by which the control can be realized by an inexpensive device.

DETAILED DESCRIPTION

One embodiment of a die-cushion device of a press machine according to the present invention will be described in details according to the attached drawings.

[Configuration of a Die-Cushion Device]

Figure 1:
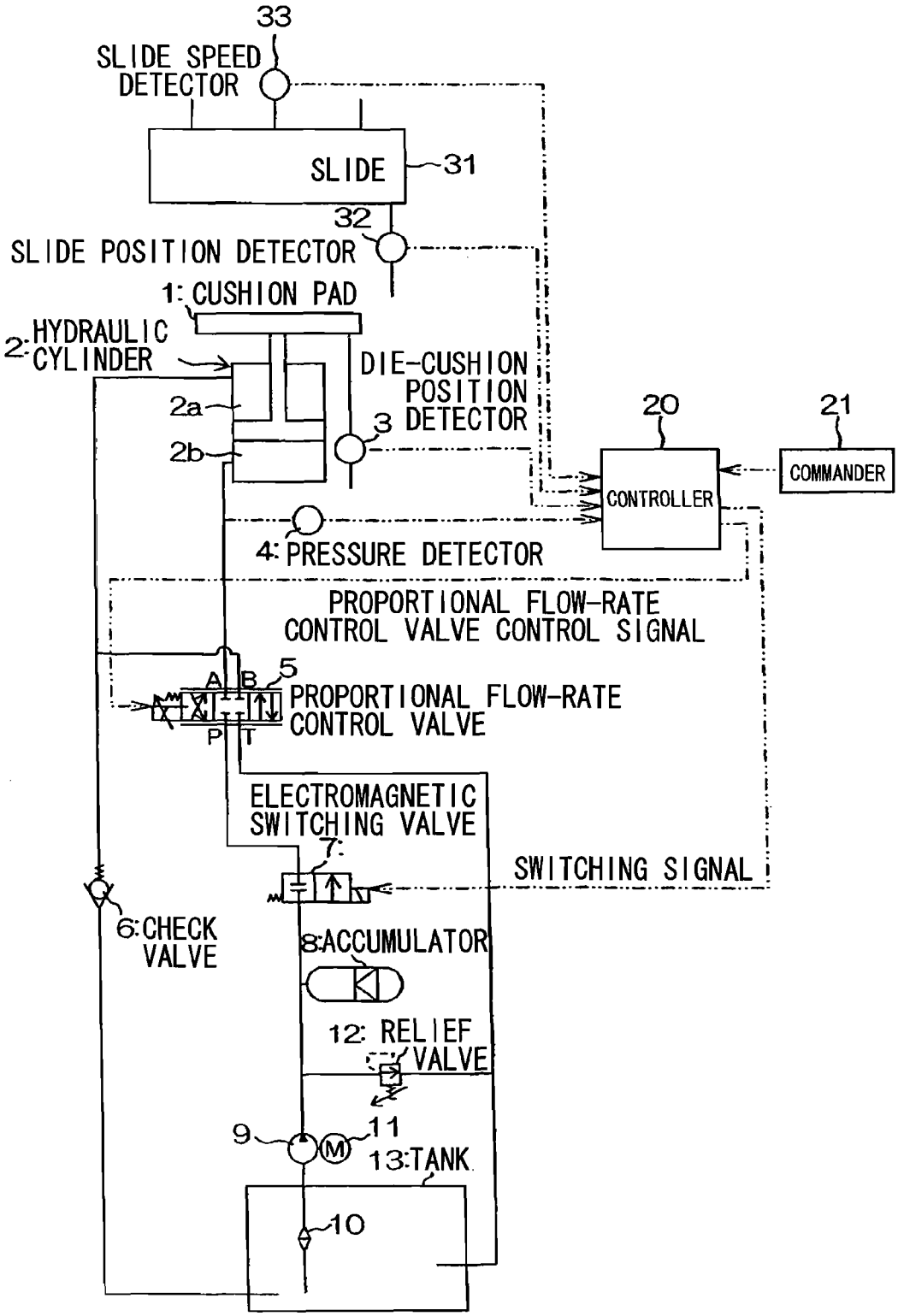
FIG. 1 is a diagram illustrating an embodiment of a die-cushion device of a press machine according to the present invention.

FIG. 1 is a diagram illustrating an embodiment of the die-cushion device of a press machine according to the present invention. In the FIG. 1, a cushion pad 1 is supported by a single or a plurality of hydraulic cylinders 2. At the cushion pad 1, a die-cushion position detector 3 (or proximity switch) is provided.

To a flow passage connected to a lower chamber 2*b* side of the hydraulic cylinder 2, a pressure detector 4 for detecting the pressure of the lower chamber 2*b* is connected and an A port of a 4-port 2-position proportional flow-rate control valve (hereinafter, referred to simply as "proportional flow-rate control valve") 5 is connected, while to a flow passage connected to an upper chamber 2*a* side of the hydraulic cylinder 2, a B port of the proportional flow-rate control valve 5 is connected, and a tank 13 is connected through a check valve 6.

A pressure supply port (P port) of the proportional flow-rate control valve 5 is connected to a pressure oil supply source (including a pump 9, a filter 10, a motor 11, and a relief valve 12) having an accumulator 8 through an electromagnetic switching valve 7 capable of being opened/closed, and a T port of the proportional flow-rate control valve 5 is connected to the tank 13.

At a slide 31 of the press machine, a slide position detector 32 and a slide speed detector 33 are provided.

Detection signals from the die-cushion position detector 3, the pressure detector 4, the slide position detector 32 and the slide speed detector 33 are taken in by a controller 20, respectively. Also, a die-cushion pressure command and a knock-out position command from a commander 21 are applied to the controller 20.

The controller 20 is provided for die-cushion pressure control and knock-out position control, outputs a control signal for controlling the proportional flow-rate control valve 5 based on the command signal and the detection signals, and outputs a switching signal for switching the electromagnetic switching valve 7. Details of the die-cushion pressure control and the knock-out position control by this controller 20 will be described later.

[Principle of the Die-Cushion Pressure Control]

Since a die-cushion force can be represented by a product of a pressure and a cylinder area of the lower chamber 2*b* of the hydraulic cylinder 2, control of the die-cushion force means control of the pressure of the lower chamber 2*b* of the hydraulic cylinder 2.

A pressure P of the lower chamber 2*b* of the hydraulic cylinder 2 can be represented by the following formula:

$$P=(K/V)q(1/s) \tag{1}$$

Meanings of the symbols in the above formula (1) are as follows:

K: Volume elastic coefficient

V: Volume of the cylinder lower chamber (cm3)

q: Inflow/outflow amount to the cylinder lower chamber (cm3/s)

1/s: Integration

From this formula (1), it is known that if the inflow/outflow amount q into the cylinder lower chamber can be controlled, a generated pressure (die-cushion force) can be controlled.

Using Bernoulli's principle, an outflow amount Q from the cylinder lower chamber passing through the proportional flow-rate control valve 5 can be represented by the following formula by a valve coefficient Kv in proportion to the opening degree of the proportional flow-rate control valve 5 and the pressure P of the cylinder lower chamber:

$$Q = Kv\sqrt{P} \tag{2}$$

$$Kv = Cd\cdot\pi\cdot d\sqrt{(2/\rho)}\cdot x = C\cdot x(C\text{: constant}) \tag{3}$$

Meanings of the symbols in the above formula (2) are as follows:

P=Pressure [kgf/cm2]

Q: Flow rate passing through the proportional flow-rate control valve [cm3/s]

ρ=Working oil density [kgf s2/cm4]

Cd: Flow-rate coefficient d: Spool diameter of the proportional flow-rate control valve [cm]

x: Spool displacement amount [cm]

An inflow/outflow amount q into the cylinder lower chamber is obtained by subtracting an outflow amount Q from the inflow amount $Q_s$ ($q=Q_s-Q$). Since the inflow amount $Q_s$ is determined by the product of the slide speed (lowering speed of a piston of the cylinder) and the cylinder area, by controlling the outflow amount Q from the cylinder lower chamber, the pressure of the cylinder lower chamber can be controlled.

Figure 2:
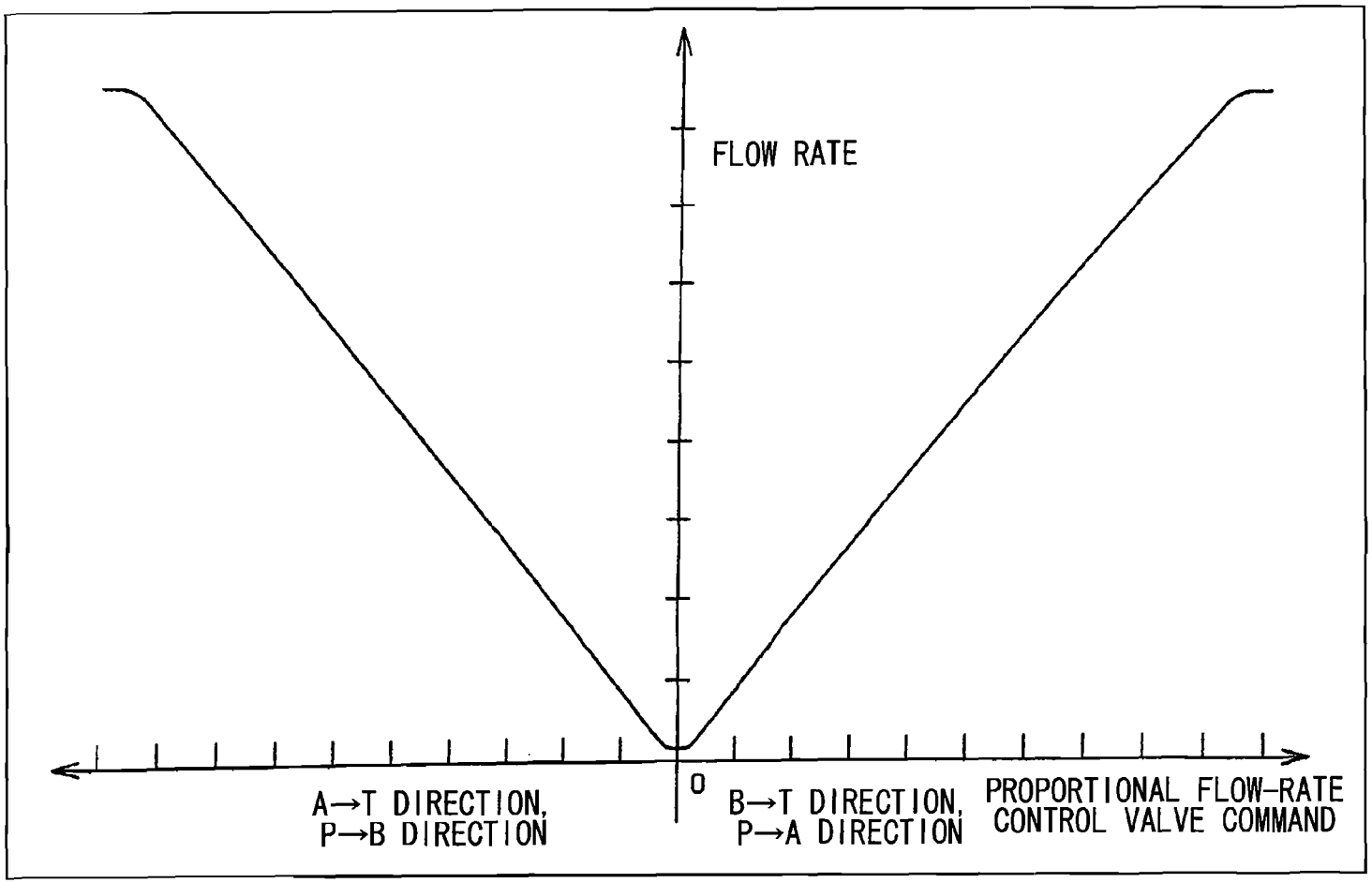
FIG. 2 is a graph illustrating a command-flow rate characteristic of a general proportional flow-rate control valve.

Also, the valve coefficient Kv is in proportion to the spool displacement amount x of the proportional flow-rate control valve as shown in the formula (3). FIG. 2 shows a command-flow rate characteristic diagram of the general proportional flow-rate control valve. Since the proportional flow-rate control valve has its spool position changed in proportion to the command as shown in the figure, if a pressure difference is constant, a passing flow rate of the working oil is determined in proportion to the proportional flow-rate control valve command as shown in FIG. 2. This command-flow rate characteristic diagram or a relation between the proportional flow-rate control valve command and the valve coefficient Kv derived from an experimental value in advance can be used.

Here, the above formula (2) can be deformed to the following formula:

$$Kv=Q\sqrt{P} \quad (2)$$

By substituting the command pressure of the die cushion as Pr and the flow rate acquired from the slide speed as $Q_s$ for Q, P in the formula (2)', the valve coefficient Kv can be obtained. By controlling the proportional flow-rate control valve so as to have the spool displacement amount (opening degree) corresponding to this valve coefficient Kv, the pressure P of the cylinder lower chamber can be controlled so as to become the command pressure Pr.

That is, when the pressure P of the cylinder lower chamber is lower than the command pressure Pr (P<Pr), the flow rate Q passing through the proportional flow-rate control valve is smaller than the inflow rate $Q_s$ into the cylinder lower chamber ($Q<Q_s$). At this time, the inflow/outflow amount q into the cylinder lower chamber ($=Q_s-Q$) is increased and the pressure P of the cylinder lower chamber is also raised. When the pressure P of the cylinder lower chamber becomes equal to the command pressure Pr (P=Pr), the outflow amount Q from the cylinder lower chamber also becomes equal to the inflow amount $Q_s$ ($Q=Q_s$), and the pressure P of the cylinder lower chamber is settled at the command pressure Pr.

Therefore, even if the slide collides against the cushion pad at a high speed, by controlling the opening degree of the proportional flow-rate control valve in advance as appropriate, control can be made so that the surge pressure is not generated but a desired cushion force (pressure) can be obtained.

[Action of the Controller 20]

Figure 3A:
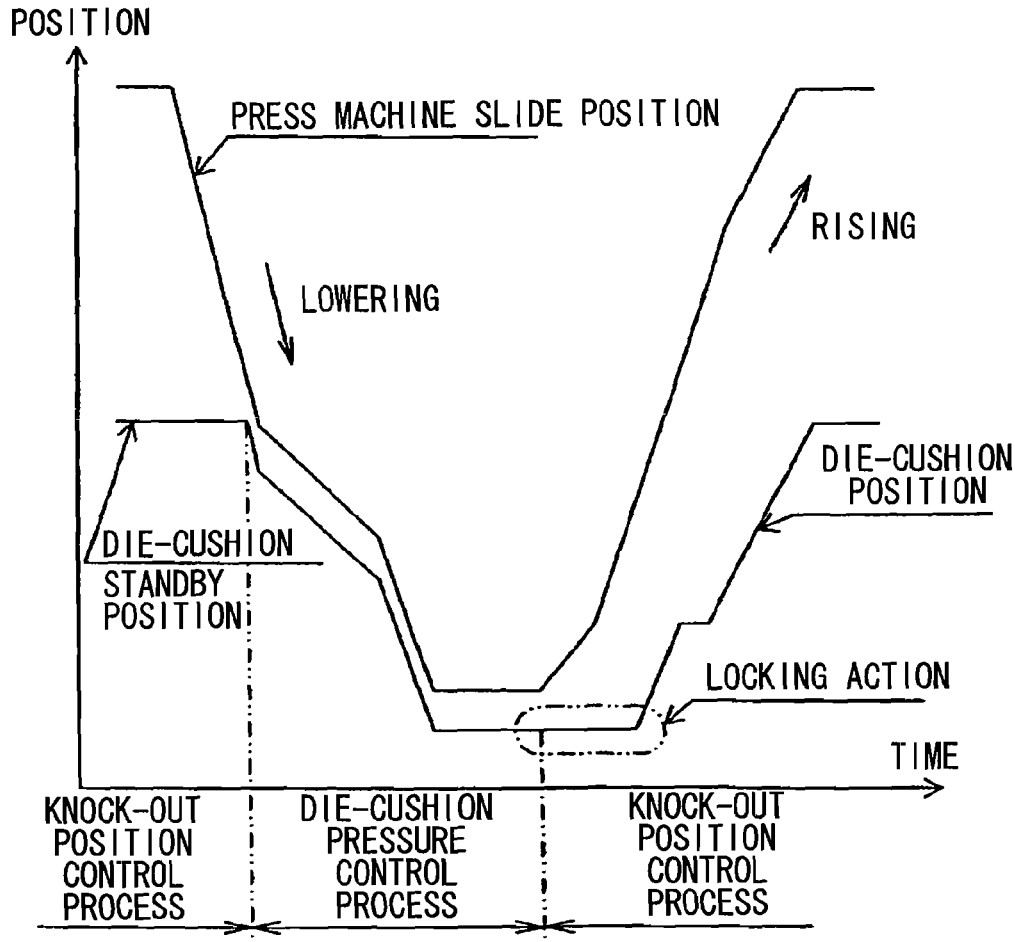
FIG. 3A is a motion diagram illustrating a change over time of a die-cushion position and a slide position.
Figure 3B:
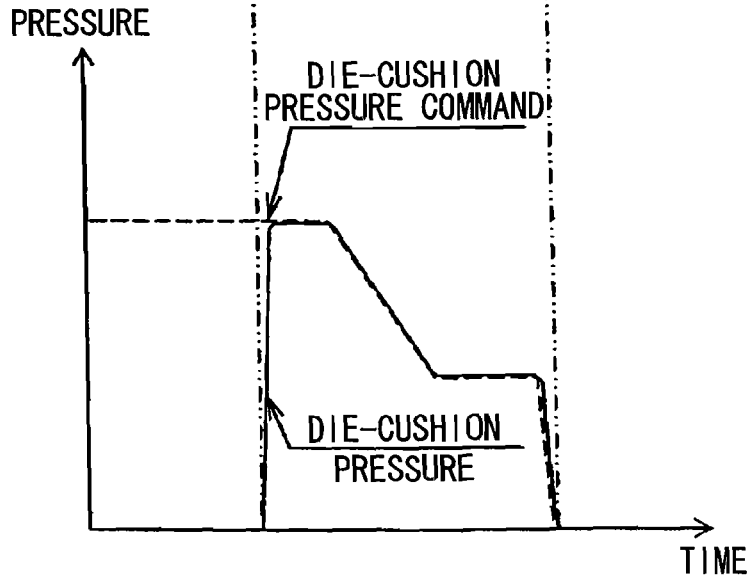
FIG. 3B is a motion diagram illustrating a change over time of a die cushion pressure.

FIG. 3A is a motion diagram illustrating a change over time of the die-cushion position and the slide position, while FIG. 3B is a motion diagram illustrating a change over time of the die-cushion pressure.

A 1-cycle control process of the die-cushion device comprises a knock-out position control process (preparation process) for position-controlling the cushion pad 1 to a standby position set in advance, a die-cushion pressure control process (molding process) for controlling the die-cushion pressure, and a knock-out position control process for controlling locking and rising of the cushion pad 1 shown in FIG. 3A.

<Preparation Process (Process for Position-Controlling the Cushion Pad to the Standby Position)>

In FIG. 1, in order to make the cushion pad 1 connected to a piston of the hydraulic cylinder 2 standby at a position set in advance, first, the controller 20 outputs a switching signal to turn ON (open) the electromagnetic switching valve 7 so as to enable supply of the working oil to the hydraulic cylinder 2. Then, the controller 20 controls the opening degree of the proportional flow-rate control valve 5 based on the position command (See FIG. 3A) from the commander 21, a position signal from the die-cushion position detector 3, and a pressure signal from the pressure detector 4.

Figure 4:
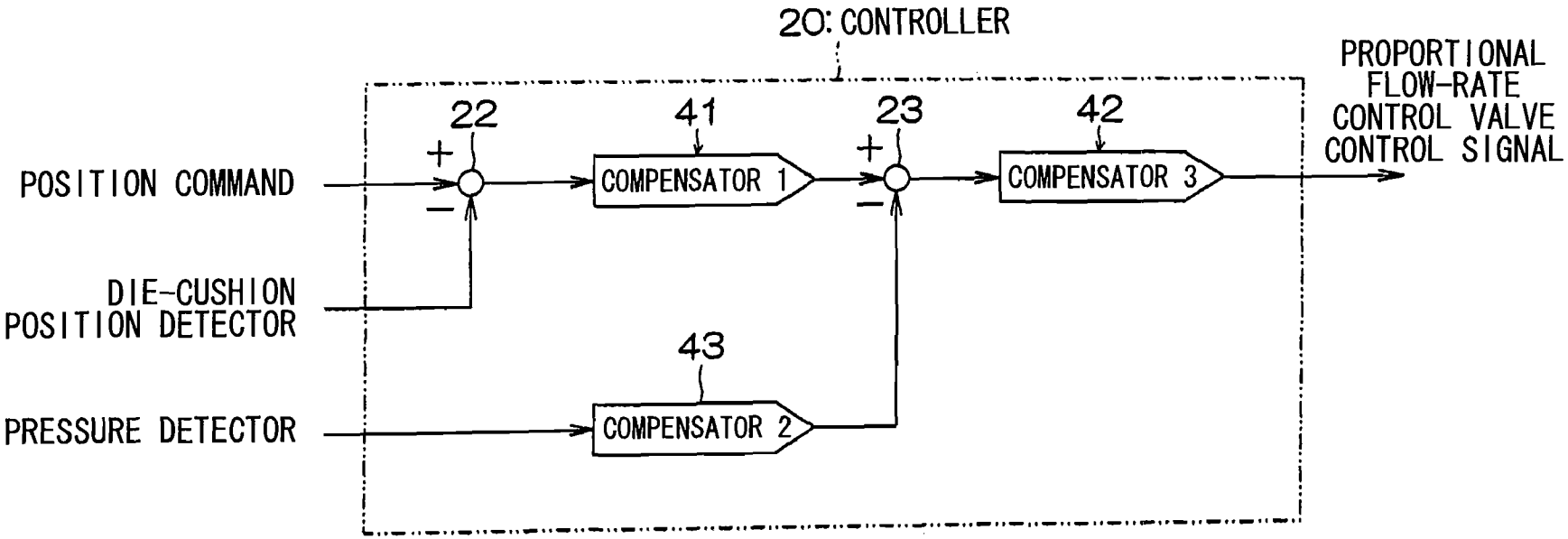
FIG. 4 is a block diagram of a controller at the knock-out position control of the die-cushion device.

FIG. 4 is a block diagram of a controller at the knock-out position control of the die-cushion device.

In FIG. 4, the position command form the commander 21 is applied to a positive input of the subtraction calculation device 22 of the controller 20. To a negative input of the subtraction calculation device 22, a position signal from the die-cushion position detector 3 is applied, and the subtraction calculation device 22 acquires a deviation between the two inputs and outputs the deviation signal to a compensator 41. The compensator 41 carries out proportional compensation, integration compensation and differentiation compensation, and the inputted deviation signal is determined as an operation amount signal through the compensator 41 and applied to the positive input of the subtraction calculation device 23.

On the other hand, a pressure signal indicating the pressure of the lower chamber 2*b* of the hydraulic cylinder 2 detected by the pressure detector 4 is applied to the negative input of the subtraction calculation device 23 as a signal for correcting the operation amount signal through a compensator 43. The subtraction calculation device 22 acquires a deviation between the two inputs and outputs the deviation signal to a compensator 42. The deviation signal is determined as a control signal for controlling the opening degree (spool position) of the proportional flow-rate control valve 5 through the compensator 42 and outputted to the proportional flow-rate control valve 5. As the proportional flow-rate control valve 5, those with spool position control function is used (not shown) so that the spool position is changed in proportion to the control signal outputted from the controller 20.

By controlling the spool position of the proportional flow-rate control valve 5, the flow rate of the working oil supplied to the hydraulic cylinder 2 and the direction to flow the working oil are controlled, and the position of the cushion pad 1 to which the hydraulic cylinder 2 is connected is controlled to be at the command position.

The position command can be a constant value in the simplest case, and a position deviation between the constant value and a current position detected by the die-cushion position detector 3 is outputted to the proportional flow-rate control valve 5 as a control signal through the compensators 41, 42. As the cushion pad 1 rises, the position deviation is reduced, and standby is carried out at a position where the position deviation gets close to 0 (theoretically it is 0, but a position deviation is generated due to influence of friction or the like).

Also, when the die-cushion position detector 3 is not used, the opening degree of the proportional flow-rate control valve 5 is made constant, and standby is carried out in the state where the cushion pad 1 is pushed upward at a die-cushion position upper limit.

<Molding Process>

As mentioned above, the cushion pad 1 connected to the piston of the hydraulic cylinder 2 is stopped at a predetermined standby position.

When the slide 31 starts lowering and reaches a set position, the controller 20 outputs a switching signal for turning OFF (closing) the electromagnetic switching valve 7 and closes the P port of the proportional flow-rate control valve 5 by the electromagnetic switching valve 7.

And the controller 20 carries out control so that the proportional flow-rate control valve 5 has an appropriate opening degree before the collision with the slide 31 using the preset pressure command and the slide speed. Even if the proportional flow-rate control valve 5 is opened by an appropriate opening degree in advance, since the P port of the proportional flow-rate control valve 5 is shut off, the standby position of the cushion pad 1 is hardly changed. Also, since the proportional flow-rate control valve 5 is opened by an appropriate opening degree in a direction from the A port to the T port, generation of surge pressure at the collision can be prevented.

Figure 5:
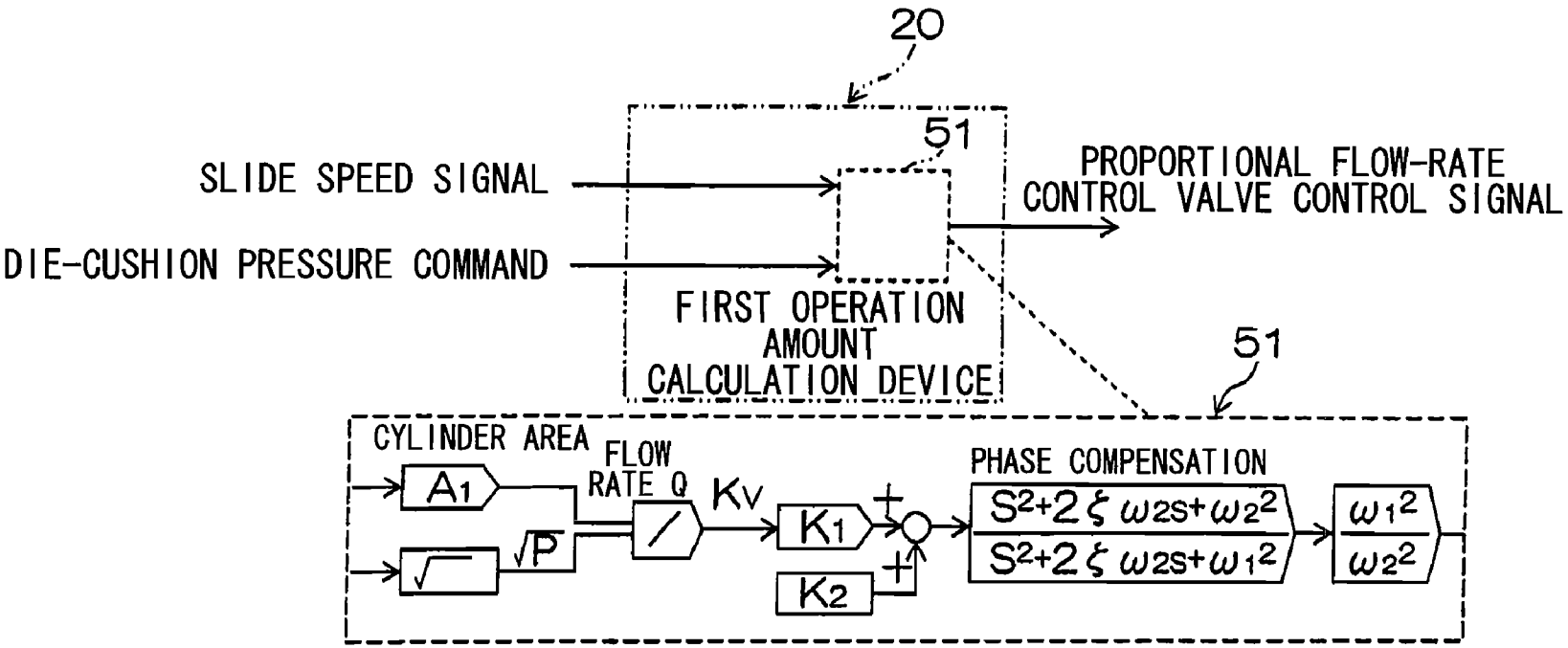
FIG. 5 is a block diagram illustrating a one embodiment of a controller at the die-cushion pressure control of the die-cushion device.

FIG. 5 is a block diagram showing one embodiment of the controller at die-cushion pressure control of the die-cushion device.

In FIG. 5, a slide speed signal from the slide speed detector 33 and a die-cushion pressure command (broken line in FIG. 3B) from the commander 21 are applied to the first operation amount calculation device 51 in the controller 20, respectively. The first operation amount calculation device 51 generates a control signal for controlling the opening degree of the proportional flow-rate control valve 5 based on the two inputs and outputs it to the proportional flow-rate control valve 5 for controlling the opening degree of the proportional flow-rate control valve 5.

The first operation amount calculation device 51 calculates the flow rate Q discharged from the lower chamber 2*b* of the hydraulic cylinder 2 by multiplying the slide speed indicated by the slide speed signal and the cylinder area of the hydraulic cylinder 2 and calculates a square root of the die-cushion pressure command. And the flow rate is divided by the square root of the pressure command so as to calculate the valve coefficient Kv (See the formula (2)').

Since the valve coefficient Kv is in proportion to the spool displacement amount x of the proportional flow-rate control valve as shown in the formula (3), the first operation amount calculation device 51 generates a control signal of the proportional flow-rate control valve 5 commanding the spool displacement amount x from the valve coefficient Kv and outputs it to the proportional flow-rate control valve 5 through a phase compensator.

In the state where the opening degree of the proportional flow-rate control valve 5 is controlled as above, the cushion pad 1 is pushed down by lowering of the slide 31. After the slide 31 is brought into contact with the cushion pad 1, the position and speed of the cushion pad 1 depends on the position and speed of the slide 31 (operating in conjunction).

At this time, oil flows into the upper chamber 2*a* of the hydraulic cylinder 2 from the tank 13 through a check valve 6.

On the other hand, since the P port of the proportional flow-rate control valve 5 is shut off, the oil of the lower chamber 2*b* of the hydraulic cylinder 2 is given only meter-out control of flowing from the A port to the T port. Since the die-cushion pressure control is carried out only by the meter-out control, system pressure of the hydraulic device can be configured with a pressure lower than the die-cushion set pressure, by which a motor capacity can be reduced and the price of the device can be lowered.

The controller 20 controls the proportional flow-rate control valve 5 by the spool displacement amount (opening degree) of the proportional flow-rate control valve 5 calculated as above and controls the die-cushion pressure. Since the opening degree of the proportional flow-rate control valve 5 is controlled to an appropriate opening degree in the direction from the A port to the T port before the cushion pad 1 is pushed downward, generation of the surge pressure is restricted and die-cushion pressure control not depending on the slide speed or oil temperature is enabled.

Also, by continuously changing the opening degree (communication shut-off area) of the proportional flow-rate control valve 5 according to the change of the die-cushion pressure command and slide speed, the die-cushion pressure can be made to follow an arbitrary pressure command curve (broken line in FIG. 3B) set in advance.

Figure 6:
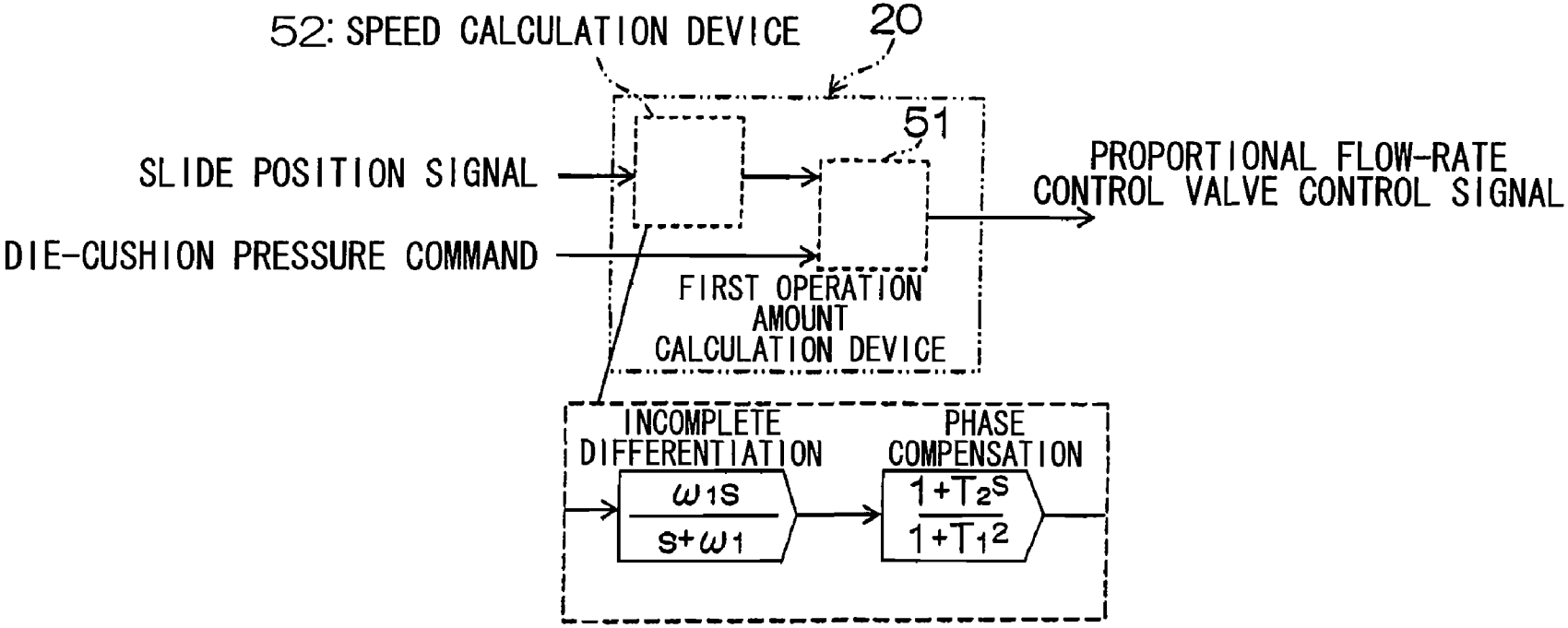
FIG. 6 is a block diagram illustrating another embodiment of a controller at the die-cushion pressure control of the die-cushion device.

FIG. 6 is a block diagram showing another embodiment of the controller at the die-cushion pressure control of the die-cushion device. The common portions as those of the first embodiment shown in FIG. 5 are given the same reference numerals and the detailed description will be omitted.

In the controller 20 in the embodiment shown in FIG. 5, a slide speed signal is inputted from the slide speed detector 33, but the controller 20 of the embodiment shown in FIG. 6 is different in the point that a slide position signal is inputted from the slide position detector 32.

The controller 20 shown in FIG. 6 is provided with speed calculation device 52 for calculating a slide speed signal from the slide position signal. The speed calculation device 52 calculates the slide speed signal through incomplete differentiation and moreover, phase compensation of the slide position signal. The slide speed signal calculated by this speed calculation device 52 is outputted to the first operation amount calculation device 51. By this, the controller 20 can output the proportional flow-rate control valve control signal similar to that of the embodiment of FIG. 5.

Figure 7:
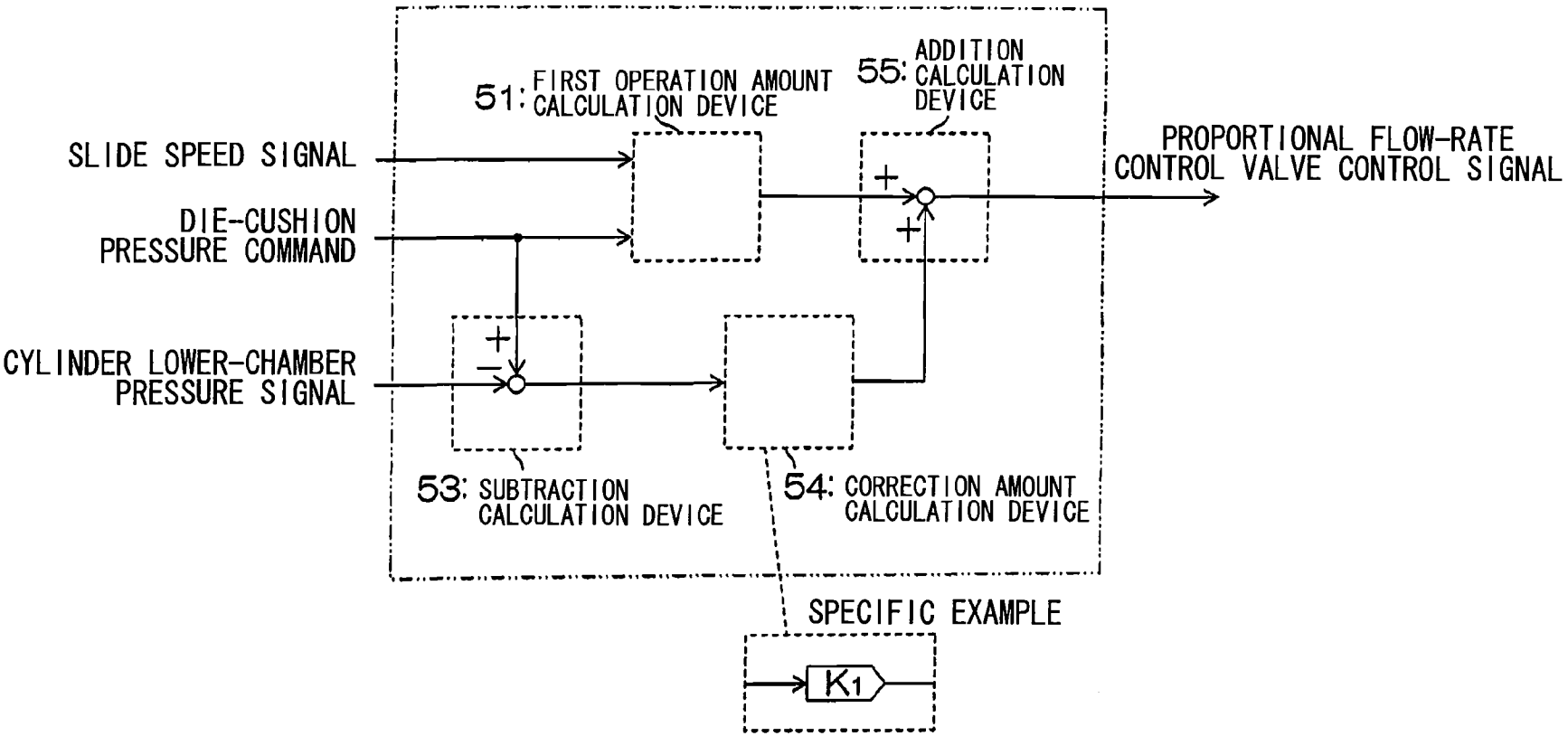
FIG. 7 is a block diagram illustrating yet another embodiment of a controller at the die-cushion pressure control of the die-cushion device.

FIG. 7 is a block diagram showing another embodiment of the controller at the die-cushion pressure control of the die-cushion device. The common portions as those of the embodiment shown in FIG. 5 are given the same reference numerals and the detailed description of those portions is omitted.

To the controller 20 of the embodiment shown in FIG. 7, in addition to the slide speed signal and the die-cushion pressure command, a pressure signal of the hydraulic cylinder lower chamber 2*b* detected by the pressure detector 4 is applied.

The die-cushion pressure command and the pressure signal are applied to a subtraction calculation device 53, and the subtraction calculation device 53 acquires a deviation of these two inputs and outputs the deviation signal to a correction amount calculation device 54. The correction amount calculation device 54 calculates a correction amount by amplifying the inputted deviation signal by a required gain and outputs the correction amount to an addition calculation device 55.

To the other inputs of the addition calculation device 55, an operation amount for controlling the opening degree of the proportional flow-rate control valve 5 is applied from the first operation amount calculation device, and the addition calculation device 55 adds the two inputs together and outputs the addition result as a control signal commanding the opening degree of the proportional flow-rate control valve 5.

According to the embodiment of FIG. 7, a pressure feedback of the hydraulic cylinder lower chamber 2*b* is added to the control of the opening degree of the proportional flow-rate control valve 5, which enables more accurate pressure control.

Figure 8:
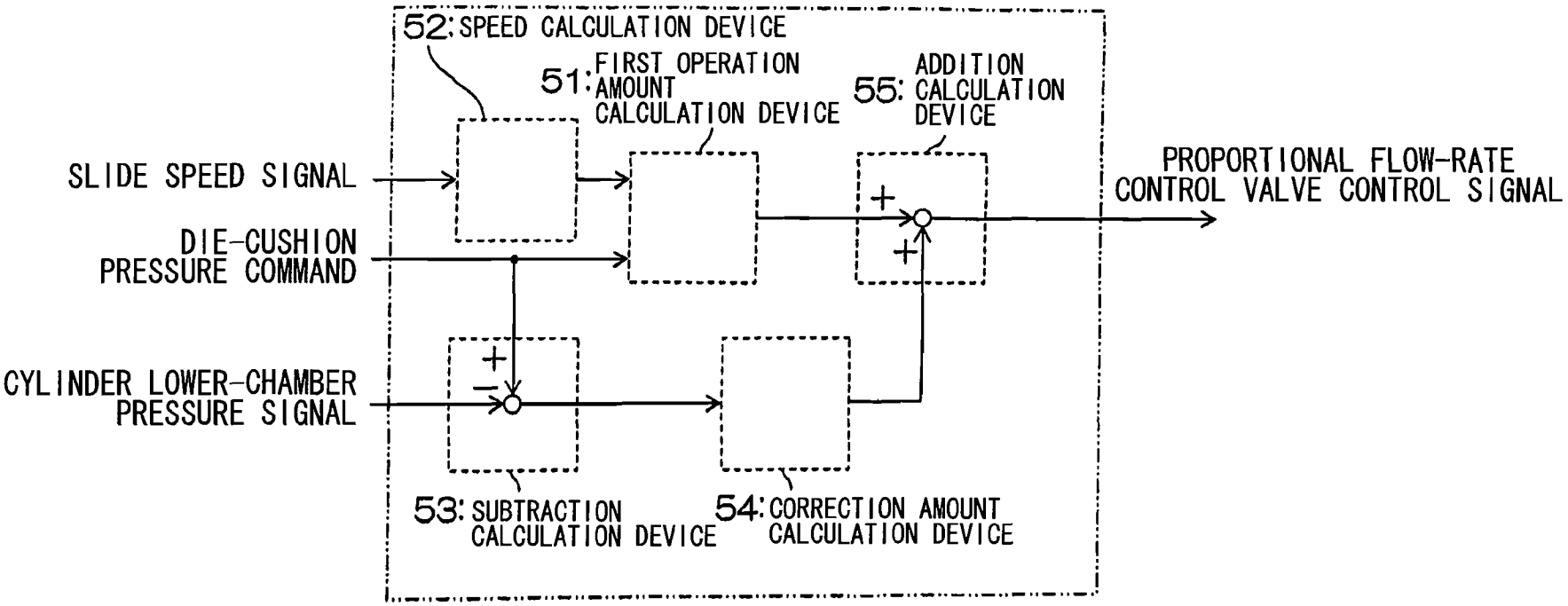
FIG. 8 is a block diagram illustrating an additional embodiment of a controller at the die-cushion pressure control of the die-cushion device.

FIG. 8 is a block diagram showing another embodiment of the controller at the die-cushion pressure control of the die-cushion device. The common portions as those of the embodiment shown in FIG. 7 are given the same reference numerals and the detailed description of those portions is omitted.

In the controller 20 in the embodiment shown in FIG. 7, a slide speed signal is inputted from the slide speed detector 33, but the controller 20 of the embodiment shown in FIG. 8 is different in the point that a slide position signal is inputted from the slide position detector 32. Since the processing of input of the slide position signal instead of input of the slide speed signal has been described in the embodiment shown in FIG. 6, the description is omitted.

Figure 9:
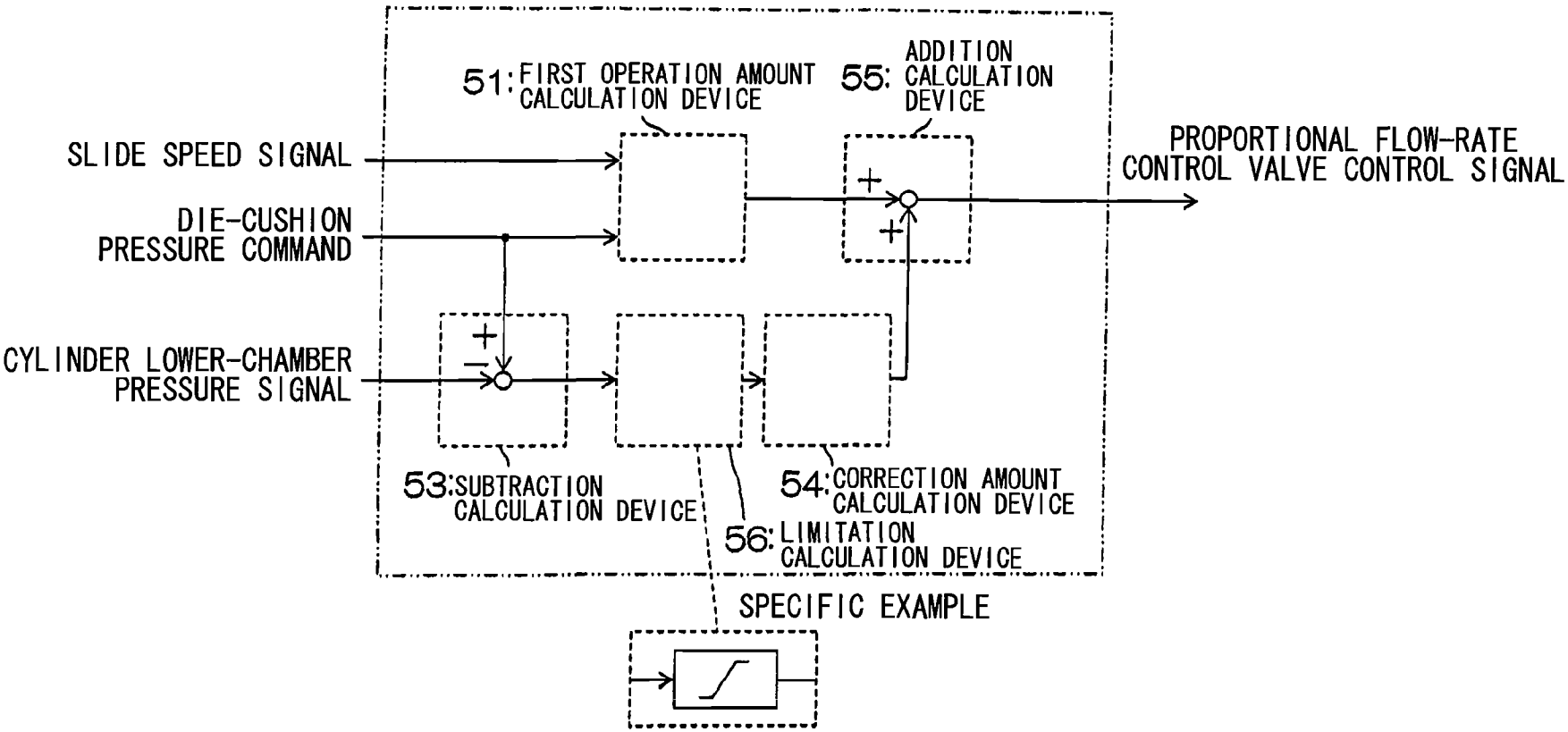
FIG. 9 is a block diagram illustrating still another embodiment of a controller at the die-cushion pressure control of the die-cushion device.

FIG. 9 is a block diagram showing yet another embodiment of the controller at the die-cushion pressure control of the die-cushion device. The common portions as those of the embodiment shown in FIG. 7 are given the same reference numerals and the detailed description of those portions is omitted.

The controller 20 of the embodiment shown in FIG. 9 is different from the embodiment shown in FIG. 7 in the point that limitation calculation device 56 is provided between the subtraction calculation device 53 and the correction amount calculation device 54.

The limitation calculation device 56 executes limitation so that the subtraction result of the subtraction calculation device 53 does not exceed predetermined maximum value and minimum value. By this, stability of the control system by the pressure feedback is ensured.

Figure 10:
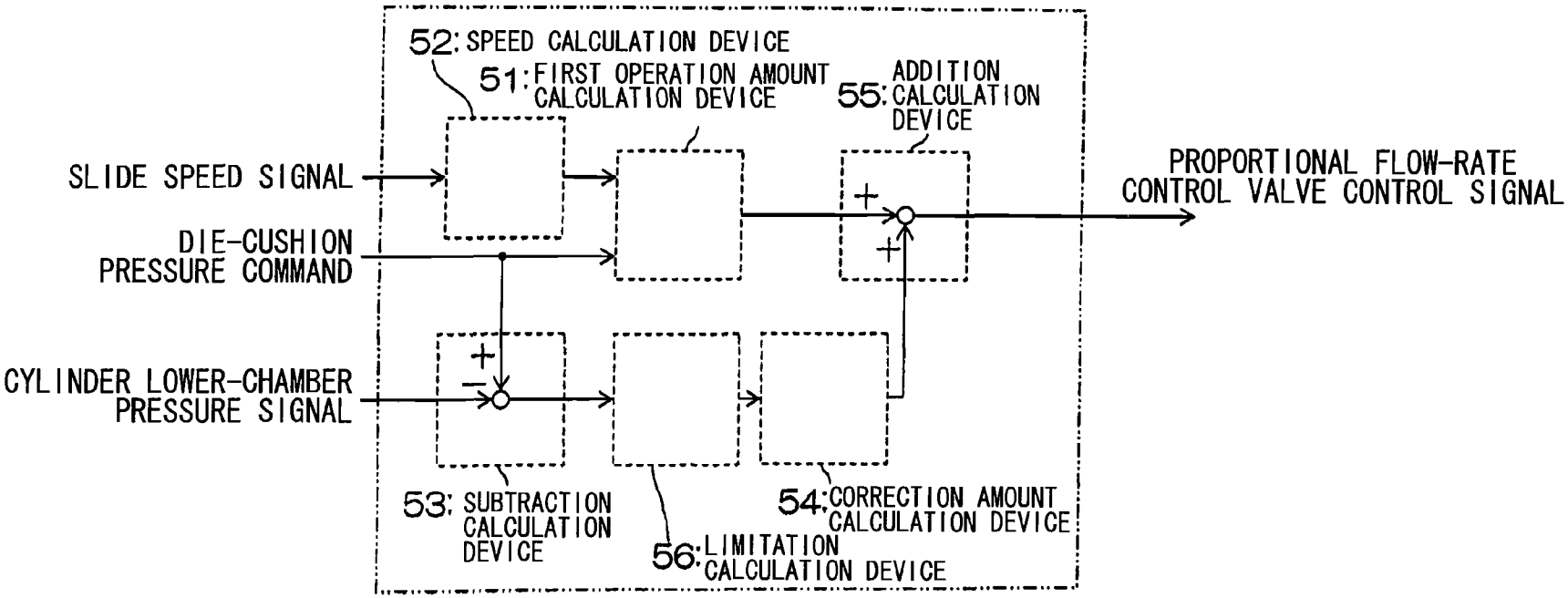
FIG. 10 is a block diagram illustrating another embodiment of a controller at the die-cushion pressure control of the die-cushion device.

FIG. 10 is a block diagram showing another embodiment of the controller at the die-cushion pressure control of the die-cushion device. The common portions as those of the embodiment shown in FIG. 9 are given the same reference numerals and the detailed description is omitted.

In the controller 20 of the embodiment shown in FIG. 9, the slide speed signal is inputted from the slide speed detector 33, but the controller 20 of the embodiment shown in FIG. 10 is different in the point that the slide position signal is inputted from the slide position detector 32. Since the processing of input of the slide position signal instead of input of the slide speed signal has been described in the embodiment shown in FIG. 6, the description of processing input is omitted.

Figure 11:
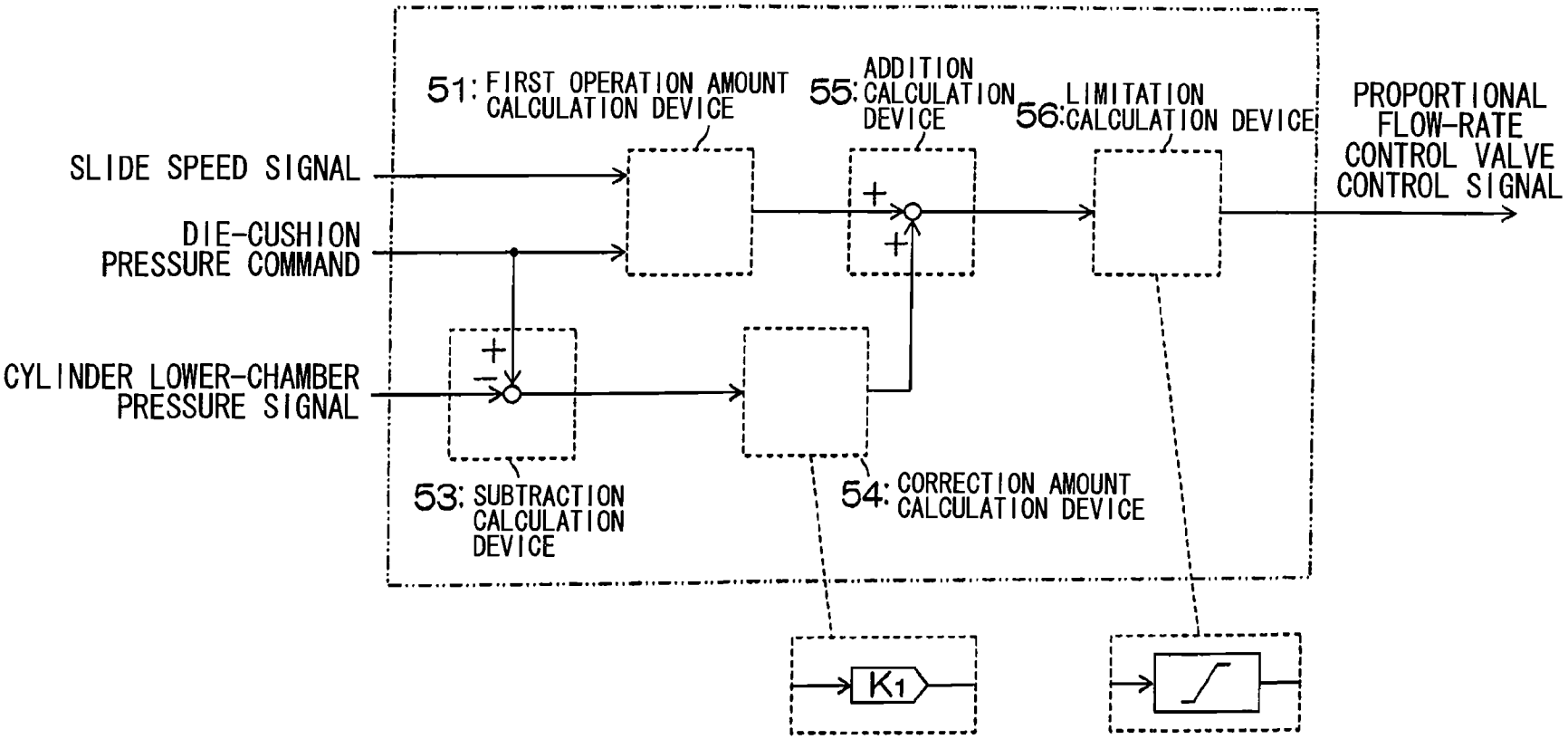
FIG. 11 is a block diagram illustrating yet another embodiment of a controller at the die-cushion pressure control of the die-cushion device.

FIG. 11 is a block diagram showing another embodiment of the controller at the die-cushion pressure control of the die-cushion device. The common portions as those of the embodiment shown in FIG. 7 are given the same reference numerals and the detailed description will be omitted.

The controller 20 of the embodiment shown in FIG. 11 is different from the embodiment shown in FIG. 7 in the point that the limitation calculation device 56 is provided at the rear stage of the addition calculation device 55.

The limitation calculation device 56 carries out limitation so that the addition result of the addition calculation device 55 does not exceed predetermined maximum value and minimum value. By this, stability of the control system is ensured.

Figure 12:
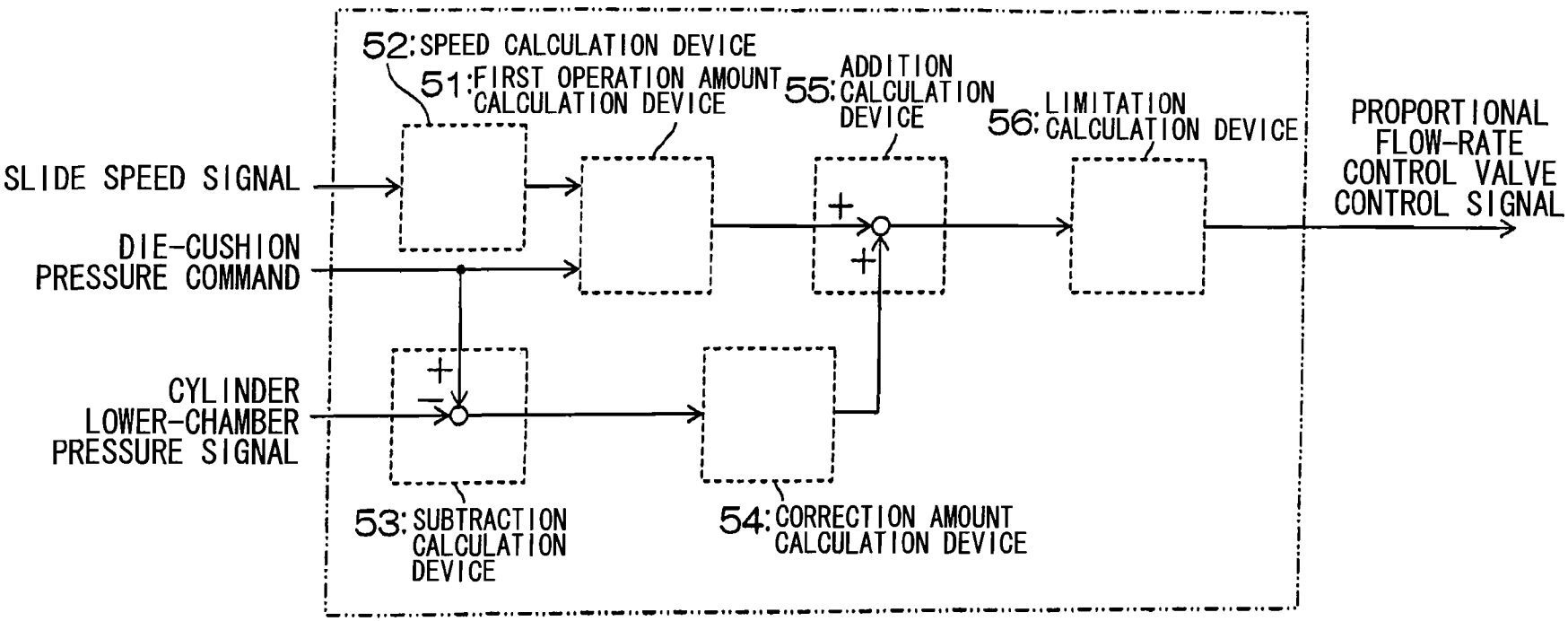
FIG. 12 is a block diagram illustrating another embodiment of a controller at the die-cushion pressure control of the die-cushion device.

FIG. 12 is a block diagram showing still another embodiment of the controller at the die-cushion pressure control of the die-cushion device. The common portions as those of the embodiment shown in FIG. 11 are given the same reference numerals and a detailed description of those portions is omitted.

In the controller 20 of the embodiment shown in FIG. 11, the slide speed signal is inputted from the slide speed detector 33, but the controller 20 of the embodiment shown in FIG. 12 is different in the point that the slide position signal is inputted from the slide position detector 32. Since the processing of input of the slide position signal instead of input of the slide speed signal has been described in the embodiment shown in FIG. 6, the description of it is omitted.

<Molding Completed to Knock-Out Process>

By the molding process, molding is carried out to the bottom dead center of the press with the preset die-cushion pressure and molding of the molded product is completed.

In the vicinity of the bottom dead center, the slide speed of the press machine becomes 0, and an oil amount discharged from the hydraulic cylinder lower chamber 2*b* side is also decreased in proportion to the cushion pad speed changing with the slide speed. After the slide 31 reaches the bottom dead center, the die-cushion pressure command becomes 0 (See FIG. 3B), the opening degree of the proportional flow-rate control valve 5 is opened based on the control signal from the controller 20, and the pressure of the hydraulic cylinder lower chamber 2*b* becomes 0.

<Knock-Out Process>

In this case, the controller 20 outputs a switching signal for turning ON (opening) the electromagnetic switching valve 7 so as to enable supply of the working oil to the P port of the hydraulic cylinder 2. Then, the controller 20 controls the opening degree of the proportional flow-rate control valve 5 as described in the block diagram in FIG. 4 based on the position command from the commander 21 (See FIG. 3A), the position signal from the die-cushion position detector 3, and the pressure signal form the pressure detector 4 and carries out position control of the cushion pad 1.

As shown in FIG. 3A, when the cushion pad position command is held for a predetermined time as the cushion pad position command at the slide bottom dead center, the slide 31 rises after that, but the cushion pad position remains at the bottom dead center. This corresponds to the locking action of the pneumatic die-cushion and is a measure to prevent interference between the molded product on the cushion pad 1 and the upper die while the slide 31 is raised to some position.

After the measure corresponding to the locking action, the die-cushion position command to gradually raise the cushion pad 1 as shown in FIG. 3A is given to have it standby at the above-mentioned die-cushion standby position.

In the embodiments shown in FIGS. 5, 7, 9 and 11, the slide speed signal detected by the slide speed detector 33 is inputted, but after the collision of the slide 31 against the cushion pad 1, the cushion pad 1 is lowered together with the slide 31. Thus, the cushion pad speed signal may be inputted instead of the slide speed signal. Similarly, in the embodiments shown in FIGS. 6, 8, 10 and 12, the slide position signal detected by the slide position detector 32 is inputted, but after the collision of the slide 31 against the cushion pad 1, the cushion pad 1 is lowered together with the slide 31. Thus, the cushion pad position signal may be inputted instead of the slide position signal.

Also, not limited to the case of the direct detection of the speed of the slide 31, the slide speed may be detected by detecting an angular speed of the driving shaft of the press machine (driving shaft of an electric press, for example). Also, by calculating an angular speed through temporal differentiation of an angle of the driving shaft of the press machine, the slide speed may be detected from this calculated angular speed.

Moreover, the case where oil is used as the working liquid of the cylinder was described in this embodiment, but not limited to this, water or any other liquid may be used. Also, the proportional flow-rate control valve includes a servo valve having a flow-rate control function.

As mentioned above, according to the present invention, at the collision between the slide and the die-cushion, since the opening degree of the proportional flow-rate control valve is controlled so that the die-cushion pressure becomes the command pressure using the preset die-cushion pressure command and the slide speed (or cushion pad speed after the collision), generation of a surge pressure can be prevented. Also, when the changing die-cushion pressure command is given, the die-cushion pressure can be controlled with favorable follow-up capability according to the pressure command. Moreover, since the die-cushion pressure control and the knock-out position control can be made using a single proportional flow-rate control valve, the control can be realized with an inexpensive device.

The invention claimed is:

1. A die-cushion device of a press machine comprising:

a liquid-pressure cylinder which supports a cushion pad, the cushion pad configured to lower as a result of a collision with a slide of the press machine;

a proportional flow-rate control valve provided in a flow passage connected to a lower chamber of the liquid-pressure cylinder;

a die-cushion pressure command device which outputs a die-cushion pressure command set in advance;

a slide speed detecting device which detects a slide speed of the press machine; and a control device which controls a flow rate discharged from the lower chamber of the liquid-pressure cylinder by controlling an opening degree of the proportional flow-rate control valve, wherein the control device controls the opening degree of the proportional flow-rate control valve before the cushion pad starts lowering so that the die-cushion pressure becomes a pressure corresponding to the die-cushion pressure command from the time of lowering of the cushion pad resulting from the collision, wherein the controlling of the opening degree is based on the die-cushion pressure command and the slide speed detected by the slide speed detecting device.

2. The die-cushion device of a press machine according to claim 1, wherein where a flow rate discharged from the lower chamber of the liquid-pressure cylinder in proportion to the slide speed detected by the slide speed detecting device is Q and a pressure of the lower chamber of the liquid-pressure cylinder is P, a valve coefficient $K_V$ in proportion to the opening degree of the proportional flow-rate control valve is represented from Bernoulli's principle as follows:

$$K_V = Q/\sqrt{P}$$

and the control device controls the opening degree of the proportional flow-rate control valve based on the valve coefficient acquired by dividing the flow rate calculated using the slide speed detected by the slide speed detecting device by a square root of the pressure command.

3. The die-cushion device of a press machine according to claim 1, wherein the slide speed detecting device is a speed calculating device which calculates a speed by temporal differentiation of a position signal from a position detecting device that detects a slide position or a cushion pad position of the press machine, an angular speed detecting device which detects an angular speed of a driving shaft of the press machine, or an angular speed calculating device which calculates an angular speed by temporal differentiation of an angular signal from an angle detecting device that detects an angle of the driving shaft of the press machine.

4. The die-cushion device of a press machine according to claim 1, wherein the control device has a first operation amount calculation device which calculates an operation amount of the proportional flow-rate control valve based on the die-cushion pressure command and the slide speed detected by the slide speed detecting device and controls the opening degree of the proportional flow-rate control valve based on the operation amount.

5. The die-cushion device of a press machine according to claim 2, wherein the control device has a first operation amount calculation device which calculates an operation amount of the proportional flow-rate control valve based on the die-cushion pressure command and the slide speed detected by the slide speed detecting device and controls the opening degree of the proportional flow-rate control valve based on the operation amount.

6. The die-cushion device of a press machine according to claim 1, wherein the control device has a first operation amount calculation device which calculates an operation amount of the proportional flow-rate control valve based on the die-cushion pressure command and the slide speed detected by the slide speed detecting device, a pressure detecting device which detects a pressure of the lower chamber of the liquid-pressure cylinder, a subtraction calculation device which subtracts a pressure signal detected from the die-cushion pressure command, a correction amount calculation device which calculates a correction amount of the proportional flow-rate control valve based on the subtraction result, and an addition calculation device which adds the operation amount and the correction amount together and controls the opening degree of the proportional flow-rate control valve based on the addition result.

7. The die-cushion device of a press machine according to claim 2, wherein the control device has a first operation amount calculation device which calculates an operation amount of the proportional flow-rate control valve based on the die-cushion pressure command and the slide speed detected by the slide speed detecting-device, a pressure detecting device which detects a pressure of the lower chamber of the liquid pressure cylinder, a subtraction calculation device which subtracts a pressure signal detected from the die-cushion pressure command, a correction amount calculation device which calculates a correction amount of the proportional flow-rate control valve based on the subtraction result, and an addition calculation device which adds the operation amount and the correction amount together and controls the opening degree of the proportional flow-rate control valve based on the addition result.

8. The die-cushion device of a press machine according to claim 1, wherein the control device has a first operation amount calculation device which calculates an operation amount of the proportional flow-rate control valve based on the die-cushion pressure command and the slide speed detected by the slide speed detecting device, a pressure detecting device which detects a pressure of the lower chamber of the liquid-pressure cylinder, a subtraction calculation device which subtracts the detected pressure signal from the die-cushion pressure command, a limitation calculation device which applies a limitation to the subtraction result, a correction amount calculation device which calculates a correction amount of the proportional flow-rate control valve based on the limitation result, and an addition calculation device which adds the operation amount and the correction amount together and controls the opening degree of the proportional flow-rate control valve based on the addition result.

9. The die-cushion device of a press machine according to claim 2, wherein the control device has a first operation amount calculation device which calculates an operation amount of the proportional flow-rate control valve based on the die-cushion pressure command and the slide speed detected by the slide speed detecting device, a pressure detecting device which detects a pressure of the lower chamber of the liquid-pressure cylinder, a subtraction calculation device which subtracts the detected pressure signal from the die-cushion pressure command, a limitation calculation device which applies a limitation to the subtraction result, a correction amount calculation device which calculates a correction amount of the proportional flow-rate control valve based on the limitation result, and an addition calculation device which adds the operation amount and the correction amount together and controls the opening degree of the proportional flow-rate control valve based on the addition result.

10. The die-cushion device of a press machine according to claim 1, wherein the control device has a first operation amount calculation device which calculates an operation amount of the proportional flow-rate control valve based on the die-cushion pressure command and the slide speed detected by the slide speed detecting device, a pressure detecting device which detects a pressure of the lower chamber of the liquid-pressure cylinder, a subtraction calculation device which subtracts the detected pressure signal from the die-cushion pressure command, a correction amount calculation device which calculates a correction amount of the proportional flow-rate control valve based on the subtraction result, an addition calculation device which adds the operation amount and the correction amount together, and a limitation calculation device which applies a limitation to the addition result and controls the opening degree of the proportional flow-rate control valve based on the limitation result.

11. The die-cushion device of a press machine according to claim 2, wherein the control device has a first operation amount calculation device which calculates an operation amount of the proportional flow-rate control valve based on the die-cushion pressure command and the slide speed detected by the slide speed detecting device, a pressure detecting device which detects a pressure of the lower chamber of the liquid-pressure cylinder, a subtraction calculation device which subtracts the detected pressure signal from the die-cushion pressure command, a correction amount calculation device which calculates a correction amount of the proportional flow-rate control valve based on the subtraction result, an addition calculation device which adds the operation amount and the correction amount together, and a limitation calculation device which applies a limitation to the addition result and controls the opening degree of the proportional flow-rate control valve based on the limitation result.

12. The die-cushion device of a press machine according to claim 1, further comprising a liquid-pressure circuit having a state that is switchable between a pressure controlled state for controlling the die-cushion pressure and a position controlled state for controlling a knock-out position, the knock-out position being a position of the die-cushion when a pressed product is released from the die, wherein:

the proportional flow-rate control valve is a 4-port 2-position proportional flow-rate control valve having an A port connected to the lower chamber of the liquid-pressure cylinder, a B port connected to an upper chamber of the liquid-pressure cylinder, a P port connected to a high-pressure source side, and a T port connected to a tank and has an electromagnetic switching valve for opening/closing a flow passage between the P port and the high-pressure source; and the liquid-pressure circuit, in the position controlled state, prevents an inflow of a pressure liquid from the high-pressure source to the liquid-pressure cylinder through closing of the electromagnetic switching valve at die-cushion pressure control and adjusting the opening degree of the 4-port 2-position proportional flow-rate control valve through an outflow amount from the lower chamber of the liquid-pressure cylinder; and the liquid-pressure circuit, in the position controlled state, enables the inflow of the pressure liquid from the high pressure source to the liquid-pressure cylinder through opening of the electromagnetic switching valve and adjusts the opening degree of the proportional flow-rate control valve in controlling the knock-out position.

13. The die-cushion device of a press machine according to claim 2, further comprising a liquid-pressure circuit having a state that is switchable between a pressure controlled state for controlling the die-cushion pressure and a position controlled state for controlling a knock-out position, the knock-out position being a position of the die-cushion when a pressed product is released from the die, wherein:

the proportional flow-rate control valve is a 4-port 2-position proportional flow-rate control valve having an A port connected to the lower chamber of the liquid-pressure cylinder, a B port connected to an upper chamber of the liquid-pressure cylinder, a P port connected to a high-pressure source side, and a T port connected to a tank and has an electromagnetic switching valve for opening/closing a flow passage between the P port and the high-pressure source; and the liquid-pressure circuit, in the position controlled state, prevents an inflow of a pressure liquid from the high-pressure source to the liquid-pressure cylinder through closing of the electromagnetic switching valve at die-cushion pressure control and adjusting the opening degree of the 4-port 2-position proportional flow-rate control valve through an outflow amount from the lower chamber of the liquid-pressure cylinder; and the liquid-pressure circuit, in the position controlled state, enables the inflow of the pressure liquid from the high pressure source to the liquid-pressure cylinder through opening of the electromagnetic switching valve and adjusts the opening degree of the proportional flow-rate control valve in controlling the knock-out position.

14. The die-cushion device of a press machine according to claim 3, further comprising a liquid-pressure circuit having a state that is switchable between a pressure controlled state for controlling the die-cushion pressure and a position controlled state for controlling a knock-out position, the knock-out position being a position of the die-cushion when a pressed product is released from the die, wherein:

the proportional flow-rate control valve is a 4-port 2-position proportional flow-rate control valve having an A port connected to the lower chamber of the liquid-pressure cylinder, a B port connected to an upper chamber of the liquid-pressure cylinder, a P port connected to a high-pressure source side, and a T port connected to a tank and has an electromagnetic switching valve for opening/closing a flow passage between the P port and the high-pressure source; and the liquid-pressure circuit, in the position controlled state, prevents an inflow of a pressure liquid from the high-pressure source to the liquid-pressure cylinder through closing of the electromagnetic switching valve at die-cushion pressure control and adjusting the opening degree of the 4-port 2-position proportional flow-rate control valve through an outflow amount from the lower chamber of the liquid-pressure cylinder; and the liquid-pressure circuit, in the position controlled state, enables the inflow of the pressure liquid from the high-pressure source to the liquid-pressure cylinder through opening of the electromagnetic switching valve and adjusts the opening degree of the proportional flow-rate control valve in controlling the knock-out position.

15. The die-cushion device of a press machine according to claim 4, further comprising a liquid-pressure circuit having a state that is switchable between a pressure controlled state for controlling the die-cushion pressure and a position controlled state for controlling a knock-out position, the knock-out position being a position of the die-cushion when a pressed product is released from the die, wherein:

the proportional flow-rate control valve is a 4-port 2-position proportional flow-rate control valve having an A port connected to the lower chamber of the liquid-pressure cylinder, a B port connected to an upper chamber of the liquid-pressure cylinder, a P port connected to a high-pressure source side, and a T port connected to a tank and has an electromagnetic switching valve for opening/closing a flow passage between the P port and the high-pressure source; and the liquid-pressure circuit, in the position controlled state, prevents an inflow of a pressure liquid from the high-pressure source to the liquid-pressure cylinder through closing of the electromagnetic switching valve at die-cushion pressure control and adjusting the opening degree of the 4-port 2-position proportional flow-rate control valve through an outflow amount from the lower chamber of the liquid-pressure cylinder; and the liquid-pressure circuit, in the position controlled state, enables the inflow of the pressure liquid from the high pressure source to the liquid-pressure cylinder through opening of the electromagnetic switching valve and adjusts the opening degree of the proportional flow-rate control valve in controlling the knock-out position.

16. The die-cushion device of a press machine according to claim 5, further comprising a liquid-pressure circuit having a state that is switchable between a pressure controlled state for controlling the die-cushion pressure and a position controlled state for controlling a knock-out position, the knock-out position being a position of the die-cushion when a pressed product is released from the die, wherein:

the proportional flow-rate control valve is a 4-port 2-position proportional flow-rate control valve having an A port connected to the lower chamber of the liquid-pressure cylinder, a B port connected to an upper chamber of the liquid-pressure cylinder, a P port connected to a high-pressure source side, and a T port connected to a tank and has an electromagnetic switching valve for opening/closing a flow passage between the P port and the high-pressure source; and the liquid-pressure circuit, in the position controlled state, prevents an inflow of a pressure liquid from the high-pressure source to the liquid-pressure cylinder through closing of the electromagnetic switching valve at die-cushion pressure control and adjusting the opening degree of the 4-port 2-position proportional flow-rate control valve through an outflow amount from the lower chamber of the liquid-pressure cylinder; and the liquid-pressure circuit, in the position controlled state, enables the inflow of the pressure liquid from the high pressure source to the liquid-pressure cylinder through opening of the electromagnetic switching valve and adjusts the opening degree of the proportional flow-rate control valve in controlling the knock-out position.

17. The die-cushion device of a press machine according to claim 6, further comprising a liquid-pressure circuit having a state that is switchable between a pressure controlled state for controlling the die-cushion pressure and a position controlled state for controlling a knock-out position, the knock-out position being a position of the die-cushion when a pressed product is released from the die, wherein:

the proportional flow-rate control valve is a 4-port 2-position proportional flow-rate control valve having an A port connected to the lower chamber of the liquid-pressure cylinder, a B port connected to an upper chamber of the liquid-pressure cylinder, a P port connected to a high-pressure source side, and a T port connected to a tank and has an electromagnetic switching valve for opening/closing a flow passage between the P port and the high-pressure source; and the liquid-pressure circuit, in the position controlled state, prevents an inflow of a pressure liquid from the high-pressure source to the liquid-pressure cylinder through closing of the electromagnetic switching valve at die-cushion pressure control and adjusting the opening degree of the 4-port 2-position proportional flow-rate control valve through an outflow amount from the lower chamber of the liquid-pressure cylinder; and the liquid-pressure circuit, in the position controlled state, enables the inflow of the pressure liquid from the high pressure source to the liquid-pressure cylinder through opening of the electromagnetic switching valve and adjusts the opening degree of the proportional flow-rate control valve in controlling the knock-out position.

18. The die-cushion device of a press machine according to claim 7, further comprising a liquid-pressure circuit having a state that is switchable between a pressure controlled state for controlling the die-cushion pressure and a position controlled state for controlling a knock-out position, the knock-out position being a position of the die-cushion when a pressed product is released from the die, wherein:

the proportional flow-rate control valve is a 4-port 2-position proportional flow-rate control valve having an A port connected to the lower chamber of the liquid-pressure cylinder, a B port connected to an upper chamber of the liquid-pressure cylinder, a P port connected to a high-pressure source side, and a T port connected to a tank and has an electromagnetic switching valve for opening/closing a flow passage between the P port and the high-pressure source; and the liquid-pressure circuit, in the position controlled state, prevents an inflow of a pressure liquid from the high-pressure source to the liquid-pressure cylinder through closing of the electromagnetic switching valve at die-cushion pressure control and adjusting the opening degree of the 4-port 2-position proportional flow-rate control valve through an outflow amount from the lower chamber of the liquid-pressure cylinder; and the liquid-pressure circuit, in the position controlled state, enables the inflow of the pressure liquid from the high pressure source to the liquid-pressure cylinder through opening of the electromagnetic switching valve and adjusts the opening degree of the proportional flow-rate control valve at-a-in controlling the knock-out position.

19. The die-cushion device of a press machine according to claim 8, further comprising a liquid-pressure circuit having a state that is switchable between a pressure controlled state for controlling the die-cushion pressure and a position controlled state for controlling a knock-out position, the knock-out position being a position of the die-cushion when a pressed product is released from the die, wherein:

the proportional flow-rate control valve is a 4-port 2-position proportional flow-rate control valve having an A port connected to the lower chamber of the liquid-pressure cylinder, a B port connected to an upper chamber of the liquid-pressure cylinder, a P port connected to a high-pressure source side, and a T port connected to a tank and has an electromagnetic switching valve for opening/closing a flow passage between the P port and the high-pressure source; and the liquid-pressure circuit, in the position controlled state, prevents an inflow of a pressure liquid from the high-pressure source to the liquid-pressure cylinder through closing of the electromagnetic switching valve at die-cushion pressure control and adjusting the opening degree of the 4-port 2-position proportional flow-rate control valve through an outflow amount from the lower chamber of the liquid-pressure cylinder; and the liquid-pressure circuit, in the position controlled state, enables the inflow of the pressure liquid from the high pressure source to the liquid-pressure cylinder through opening of the electromagnetic switching valve and adjusts the opening degree of the proportional flow-rate control valve in controlling the knock-out position.

20. The die-cushion device of a press machine according to claim 9, further comprising a liquid-pressure circuit having a state that is switchable between a pressure controlled state for controlling the die-cushion pressure and a position controlled state for controlling a knock-out position, the knock-out position being a position of the die-cushion when a pressed product is released from the die, wherein:

the proportional flow-rate control valve is a 4-port 2-position proportional flow-rate control valve having an A port connected to the lower chamber of the liquid-pressure cylinder, a B port connected to an upper chamber of the liquid-pressure cylinder, a P port connected to a high-pressure source side, and a T port connected to a tank and has an electromagnetic switching valve for opening/closing a flow passage between the P port and the high-pressure source; and the liquid-pressure circuit, in the position controlled state, prevents an inflow of a pressure liquid from the high-pressure source to the liquid-pressure cylinder through closing of the electromagnetic switching valve at die-cushion pressure control and adjusting the opening degree of the 4-port 2-position proportional flow-rate control valve through an outflow amount from the lower chamber of the liquid-pressure cylinder; and the liquid-pressure circuit, in the position controlled state, enables the inflow of the pressure liquid from the high pressure source to the liquid-pressure cylinder through opening of the electromagnetic switching valve and adjusts the opening degree of the proportional flow-rate control valve in controlling the knock-out position.

21. The die-cushion device of a press machine according to claim 10, further comprising a liquid-pressure circuit having a state that is switchable between a pressure controlled state for controlling the die-cushion pressure and a position controlled state for controlling a knock-out position, the knock-out position being a position of the die-cushion when a pressed product is released from the die, wherein:

the proportional flow-rate control valve is a 4-port 2-position proportional flow-rate control valve having an A port connected to the lower chamber of the liquid-pressure cylinder, a B port connected to an upper chamber of the liquid-pressure cylinder, a P port connected to a high-pressure source side, and a T port connected to a tank and has an electromagnetic switching valve for opening/closing a flow passage between the P port and the high-pressure source; and the liquid-pressure circuit, in the position controlled state, prevents an inflow of a pressure liquid from the high-pressure source to the liquid-pressure cylinder through closing of the electromagnetic switching valve at die-cushion pressure control and adjusting the opening degree of the 4-port 2-position proportional flow-rate control valve through an outflow amount from the lower chamber of the liquid-pressure cylinder; and the liquid-pressure circuit, in the position controlled state, enables the inflow of the pressure liquid from the high pressure source to the liquid-pressure cylinder through opening of the electromagnetic switching valve and adjusts the opening degree of the proportional flow-rate control valve at-a-in controlling the knock-out position.

22. The die-cushion device of a press machine according to claim 11, further comprising a liquid-pressure circuit having a state that is switchable between a pressure controlled state for controlling the die-cushion pressure and a position controlled state for controlling a knock-out position, the knock-out position being a position of the die-cushion when a pressed product is released from the die, wherein:

the proportional flow-rate control valve is a 4-port 2-position proportional flow-rate control valve having an A port connected to the lower chamber of the liquid-pressure cylinder, a B port connected to an upper chamber of the liquid-pressure cylinder, a P port connected to a high-pressure source side, and a T port connected to a tank and has an electromagnetic switching valve for opening/closing a flow passage between the P port and the high-pressure source; and the liquid-pressure circuit, in the position controlled state, prevents an inflow of a pressure liquid from the high-pressure source to the liquid-pressure cylinder through closing of the electromagnetic switching valve at die-cushion pressure control and adjusting the opening degree of the 4-port 2-position proportional flow-rate control valve through an outflow amount from the lower chamber of the liquid-pressure cylinder; and the liquid-pressure circuit, in the position controlled state, enables the inflow of the pressure liquid from the high pressure source to the liquid-pressure cylinder through opening of the electromagnetic switching valve and adjusts the opening degree of the proportional flow-rate control valve in controlling the knock-out position.

23. The die-cushion device of a press machine according to claim 12, further comprising:

a knock-out position command device which outputs a knock-out position command set in advance; and a die-cushion position detecting device which detects a position of the cushion pad, and wherein the control device makes control so as to open the electromagnetic switching valve at the knock-out position control and controls the opening degree of the proportional flow-rate control valve so that the position of the die cushion becomes the position corresponding to the knock-out position command based on the knock-out position command and the position signal detected by the die-cushion position detecting device.

24. The die-cushion device of a press machine according to claim 13, further comprising:

a knock-out position command device which outputs a knock-out position command set in advance; and a die-cushion position detecting device which detects a position of the cushion pad, and wherein the control device makes control so as to open the electromagnetic switching valve at the knock-out position control and controls the opening degree of the proportional flow-rate control valve so that the position of the die cushion becomes the position corresponding to the knock-out position command based on the knock-out position command and the position signal detected by the die-cushion position detecting device.

25. The die-cushion device of a press machine according to claim 14, further comprising:

a knock-out position command device which outputs a knock-out position command set in advance; and a die-cushion position detecting device which detects a position of the cushion pad, and wherein the control device makes control so as to open the electromagnetic switching valve at the knock-out position control and controls the opening degree of the proportional flow-rate control valve so that the position of the die cushion becomes the position corresponding to the knock-out position command based on the knock-out position command and the position signal detected by the die-cushion position detecting device.

26. The die-cushion device of a press machine according to claim 15, further comprising:

a knock-out position command device which outputs a knock-out position command set in advance; and a die-cushion position detecting device which detects a position of the cushion pad, and wherein the control device makes control so as to open the electromagnetic switching valve at the knock-out position control and controls the opening degree of the proportional flow-rate control valve so that the position of the die cushion becomes the position corresponding to the knock-out position command based on the knock-out position command and the position signal detected by the die-cushion position detecting device.

27. The die-cushion device of a press machine according to claim 16, further comprising:

a knock-out position command device which outputs a knock-out position command set in advance; and a die-cushion position detecting device which detects a position of the cushion pad, and wherein the control device makes control so as to open the electromagnetic switching valve at the knock-out position control and controls the opening degree of the proportional flow-rate control valve so that the position of the die cushion becomes the position corresponding to the knock-out position command based on the knock-out position command and the position signal detected by the die-cushion position detecting device.

28. The die-cushion device of a press machine according to claim 17, further comprising:

a knock-out position command device which outputs a knock-out position command set in advance; and a die-cushion position detecting device which detects a position of the cushion pad, and wherein the control device makes control so as to open the electromagnetic switching valve at the knock-out position control and controls the opening degree of the proportional flow-rate control valve so that the position of the die cushion becomes the position corresponding to the knock-out position command based on the knock-out position command and the position signal detected by the die-cushion position detecting device.

29. The die-cushion device of a press machine according to claim 18, further comprising:

a knock-out position command device which outputs a knock-out position command set in advance; and a die-cushion position detecting device which detects a position of the cushion pad, and wherein the control device makes control so as to open the electromagnetic switching valve at the knock-out position control and controls the opening degree of the proportional flow-rate control valve so that the position of the die cushion becomes the position corresponding to the knock-out position command based on the knock-out position command and the position signal detected by the die-cushion position detecting device.

30. The die-cushion device of a press machine according to claim 19, further comprising:

a knock-out position command device which outputs a knock-out position command set in advance; and a die-cushion position detecting device which detects a position of the cushion pad, and wherein the control device makes control so as to open the electromagnetic switching valve at the knock-out position control and controls the opening degree of the proportional flow-rate control valve so that the position of the die cushion becomes the position corresponding to the knock-out position command based on the knock-out position command and the position signal detected by the die-cushion position detecting device.

31. The die-cushion device of a press machine according to claim 20, further comprising:

a knock-out position command device which outputs a knock-out position command set in advance; and a die-cushion position detecting device which detects a position of the cushion pad, and wherein the control device makes control so as to open the electromagnetic switching valve at the knock-out position control and controls the opening, degree of the proportional flow-rate control valve so that the position of the die cushion becomes the position corresponding to the knock-out position command based on the knock-out position command and the position signal detected by the die-cushion position detecting device.

32. The die-cushion device of a press machine according to claim 21, further comprising:

a knock-out position command device which outputs a knock-out position command set in advance; and a die-cushion position detecting device which detects a position of the cushion pad, and wherein the control device makes control so as to open the electromagnetic switching valve at the knock-out position control and controls the opening degree of the proportional flow-rate control valve so that the position of the die cushion becomes the position corresponding to the knock-out position command based on the knock-out position command and the position signal detected by the die-cushion position detecting device.

33. The die-cushion device of a press machine according to claim 22, further comprising:

a knock-out position command device which outputs a knock-out position command set in advance; and a die-cushion position detecting device which detects a position of the cushion pad, and wherein the control device makes control so as to open the electromagnetic switching valve at the knock-out position control and controls the opening degree of the proportional flow-rate control valve so that the position of the die cushion becomes the position corresponding to the knock-out position command based on the knock-out position command and the position signal detected by the die-cushion position detecting device.

34. The die-cushion device of a press machine according to claim 23, wherein the control device has a subtraction calculation device which subtracts a position signal detected by the die-cushion position detecting device from the knock-out position command and a second operation amount calculation device which calculates an operation amount of the proportional flow-rate control valve based on the subtraction result and controls the opening degree of the proportional flow-rate control valve based on the operation amount.

35. The die-cushion device of a press machine according to claim 24, wherein the control device has a subtraction calculation device which subtracts a position signal detected by the die-cushion position detecting device from the knock-out position command and a second operation amount calculation device which calculates an operation amount of the proportional flow-rate control valve based on the subtraction result and controls the opening degree of the proportional flow-rate control valve based on the operation amount.

36. The die-cushion device of a press machine according to claim 25, wherein the control device has a second subtraction calculation device which subtracts a position signal detected by the die-cushion position detecting device from the knock-out position command and a second operation amount calculation device which calculates an operation amount of the proportional flow-rate control valve based on the subtraction result and controls the opening degree of the proportional flow-rate control valve based on the operation amount.

37. The die-cushion device of a press machine according to claim 26, wherein the control device has a second subtraction calculation device which subtracts a position signal detected by the die-cushion position detecting device from the knock-out position command and a second operation amount calculation device which calculates an operation amount of the proportional flow-rate control valve based on the subtraction result and controls the opening degree of the proportional flow-rate control valve based on the operation amount.

38. The die-cushion device of a press machine according to claim 27, wherein the control device has a second subtraction calculation device which subtracts a position signal detected by the die-cushion position detecting device from the knock-out position command and a second operation amount calculation device which calculates an operation amount of the proportional flow-rate control valve based on the subtraction result and controls the opening degree of the proportional flow-rate control valve based on the operation amount.

39. The die-cushion device of a press machine according to claim 28, wherein the control device has a second subtraction calculation device which subtracts a position signal detected by the die-cushion position detecting device from the knock-out position command and a second operation amount calculation device which calculates an operation amount of the proportional flow-rate control valve based on the subtraction result and controls the opening degree of the proportional flow-rate control valve based on the operation amount.

40. The die-cushion device of a press machine according to claim 29, wherein the control device has a second subtraction calculation device which subtracts a position signal detected by the die-cushion position detecting device from the knock-out position command and a second operation amount calculation device which calculates an operation amount of the proportional flow-rate control valve based on the subtraction result and controls the opening degree of the proportional flow-rate control valve based on the operation amount.

41. The die-cushion device of a press machine according to claim 30, wherein the control device has a second subtraction calculation device which subtracts a position signal detected by the die-cushion position detecting device from the knock-out position command and a second operation amount calculation device which calculates an operation amount of the proportional flow-rate control valve based on the subtraction result and controls the opening degree of the proportional flow-rate control valve based on the operation amount.

42. The die-cushion device of a press machine according to claim 31, wherein the control device has a second subtraction calculation device which subtracts a position signal detected by the die-cushion position detecting device from the knock-out position command and a second operation amount calculation device which calculates an operation amount of the proportional flow-rate control valve based on the subtraction result and controls the opening degree of the proportional flow-rate control valve based on the operation amount.

43. The die-cushion device of a press machine according to claim 32, wherein the control device has a second subtraction calculation device which subtracts a position signal detected by the die-cushion position detecting device from the knock-out position command and a second operation amount calculation device which calculates an operation amount of the proportional flow-rate control valve based on the subtraction result and controls the opening degree of the proportional flow-rate control valve based on the operation amount.

44. The die-cushion device of a press machine according to claim 33, wherein the control device has a second subtraction calculation device which subtracts a position signal detected by the die-cushion position detecting device from the knock-out position command and a second operation amount calculation device which calculates an operation amount of the proportional flow-rate control valve based on the subtraction result and controls the opening degree of the proportional flow-rate control valve based on the operation amount.

45. The die-cushion device of a press machine according to claim 1, further comprising a cushion pad speed detecting device which detects a speed of the cushion pad, and wherein the control device controls the opening degree of the proportional flow-rate control valve so that the die-cushion pressure becomes a pressure corresponding to the die-cushion pressure command after the cushion pad starts lowering integrally with the slide based on either the die-cushion pressure command and the slide speed detected by the slide speed detecting device or the die-cushion pressure command and the cushion pad speed detected by the cushion pad.

46. The die-cushion device of a press machine according to claim 1, wherein the control device starts controlling an opening degree of the proportional flow-rate control valve when the slide reaches a set point located between a starting point of lowering of the slide toward the cushion pad and a starting point of lowering of the cushion pad by the collision with the slide.

* * * * *